US006987941B2

(12) United States Patent
Takeuchi et al.

(10) Patent No.: US 6,987,941 B2
(45) Date of Patent: Jan. 17, 2006

(54) DEVELOPING LIQUID COATING DEVICE, DEVELOPING DEVICE INCLUDING THE SAME AND IMAGE FORMING APPARATUS INCLUDING THE DEVELOPING DEVICE

(75) Inventors: Noriyasu Takeuchi, Kanagawa (JP); Mie Yoshino, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/059,505

(22) Filed: Feb. 17, 2005

(65) Prior Publication Data

US 2005/0147431 A1 Jul. 7, 2005

Related U.S. Application Data

(63) Continuation of application No. 10/299,698, filed on Nov. 20, 2002, now Pat. No. 6,868,246.

(30) Foreign Application Priority Data

Nov. 20, 2001 (JP) ..... 2001-354109
Jul. 5, 2002 (JP) ..... 2002-196763

(51) Int. Cl.
*G03G 15/10* (2006.01)

(52) U.S. Cl. ..... 399/237; 399/57; 399/239; 430/117

(58) Field of Classification Search ..... 299/237, 299/239, 248, 249, 57, 343, 345, 348, 71; 118/258, 261, 262; 430/117; 399/237, 239, 399/248, 249, 57, 343, 345, 348, 71
See application file for complete search history.

(56) References Cited

U.S. PATENT DOCUMENTS

| | | | | |
|---|---|---|---|---|
| 3,875,581 | A | 4/1975 | Yamashita et al. | 118/262 X |
| 4,299,902 | A | 11/1981 | Soma et al. | 399/248 X |
| 5,735,953 | A | 4/1998 | Paulsen | 118/258 X |
| 5,826,148 | A | 10/1998 | Iino et al. | 399/239 X |
| 6,311,034 | B1 | 10/2001 | Nakashima et al. | 399/239 |
| 6,512,907 | B2 | 1/2003 | Nishikawa | 399/249 |
| 2002/0098016 | A1 | 7/2002 | Kurotori et al. | 399/237 |
| 2002/0159794 | A1 | 10/2002 | Nakashima et al. | 399/237 |
| 2002/0197083 | A1 | 12/2002 | Yoshino et al. | 399/237 |
| 2003/0175048 | A1 | 9/2003 | Berg et al. | 399/237 |

FOREIGN PATENT DOCUMENTS

JP 2002-287513 10/2002

*Primary Examiner*—Sophia S. Chen
(74) *Attorney, Agent, or Firm*—Oblon, Spivak, McClelland, Maier & Neustadt, P.C.

(57) ABSTRACT

A device for coating a developing liquid included in an developing device of the present invention includes a coating member rotatable with the developing liquid deposited thereon in a preselected amount. An intermediate member has a surface contacting the surface of the coating member and is movable at the same speed and in the same direction as the surface of the coating member. Also, the surface of the intermediate member contacts the surface of a developing roller to be coated with the developing liquid and is movable in the opposite direction to the surface of the developing roller.

13 Claims, 33 Drawing Sheets

| NO. | SURFACE RESISTANCE ($\Omega/cm^2$) | COATING |
|---|---|---|
| 1 | 1.0E+06 | GOOD |
| 2 | 3.0E+06 | GOOD |
| 3 | 1.4E+10 | GOOD |
| 4 | 1.3E+11 | GOOD |
| 5 | 5.0E+12 | GOOD |
| 6 | >1.0E+13 | NO GOOD |

FIG. 34

| NO. | SURFACE ROUGHNESS Rz (μm) | ROLLER LIFE (1,000) |
|---|---|---|
| 1 | 0.64 | 20 OR LESS |
| 2 | 0.83 | 100 |
| 3 | 1.77 | 100～150 |
| 4 | 3.13 | 200～250 |
| 5 | 6.36 | 350～400 |
| 6 | 6.80 | 400 OR ABOVE |
| 7 | 12.00 | 400 OR ABOVE |
| 8 | 15.00 | 400 OR ABOVE |

DEVELOPING LIQUID COATING DEVICE, DEVELOPING DEVICE INCLUDING THE SAME AND IMAGE FORMING APPARATUS INCLUDING THE DEVELOPING DEVICE

This application is a Continuation of application Ser. No. 10/299,698 filed Nov. 20, 2002 now U.S. Pat. No. 6,868, 246.

BACKGROUND OF THE INVENTION

1. Field of the Invention

The present invention relates to a device for coating a subject member with a developing liquid deposited on a coating member in a preselected amount, a developing device for developing a latent image formed on an image carrier with the developing liquid deposited on a developer carrier, and a copier, facsimile apparatus, printer or similar image forming apparatus including the developing device.

2. Description of the Background Art

An image forming apparatus of the type developing a latent image formed on an image carrier with a highly viscous and dense developing liquid is disclosed in, e.g., Japanese Patent Laid-Open Publication Nos. 7-152254, 7-209922, and 7-219355. In this type of image forming apparatus, an optical writing unit scans the surface of an image carrier or photoconductive element uniformly charged by a charger in accordance with image data, thereby forming a latent image on the image carrier. A developing device develops the latent image with a developing liquid to thereby produce a corresponding toner image.

The developing device includes a coating device configured to uniformly coat the developing liquid stored in a reservoir on a developer carrier in a thin layer. The developer carrier is implemented as a developing roller or a developing belt by way of example and adjoins the surface of the image carrier. The developing liquid coated on the developer carrier contacts the surface of the image carrier in a developing zone where the developer carrier and image carrier are positioned close to each other. As a result, toner contained in the thin layer of the developing liquid develops the latent image formed on the image carrier for thereby producing a corresponding toner image. A blade or similar cleaning member removes the developing liquid left on the developer carrier after development and causes it to be returned to the reservoir.

Subsequently, the toner image is transferred from the image carrier to a sheet, OHP (OverHead Projector) film or similar recording medium and then fixed by a fixing device. A drum cleaner removes residual toner left on the image carrier after the image transfer.

The developing liquid consists of an insulative carrier liquid and solid toner dispersed in the carrier liquid and made up of resin and pigment. For example, the developing liquid has viscosity as high as 50 mPa.S to 10,000 mPa.S and consists of a solvent implemented by an insulative liquid of dimethylpolysiloxane oil and toner grains densely dispersed in the liquid. When the developing liquid contacts the surface of the image carrier, charged toner grains are electrostatically transferred from the developing liquid to the image carrier to thereby develop the latent image.

The amount of toner to be migrated through the developing liquid and deposited on the latent image is inversely proportional to the distance over which the, toner moves in the developing zone. Stated another way, the shorter the distance of movement of the toner in the developing zone, the higher the developing efficiency available for the latent image. To reduce this distance, the developing liquid should preferably form a layer as thin as the order of microns on the developer carrier and contact the image carrier. This is particularly true when the viscosity of the developing liquid is as high as 50 mPa.S to 10,000 mPa.S.

When the thin layer of the developing liquid develops the latent image, the density of the resulting toner image is determined by the thickness of the layer. In this respect, the thinness of the developer layer formed on the developer carrier is the key to desirable image density. In light of this, use is made of, e.g., a coating device including a coating member for coating the developing liquid on the developer carrier. The coating member may be implemented as a coating roller carved with cells in a uniform pattern (so-called photogravure roller), as taught in Japanese Patent Laid-Open Publication No. 11-265122 by way of example. After the developing liquid has been deposited on such a coating roller, a doctor blade or metering member held in contact with the coating roller removes excessive part of the developing liquid, thereby metering the developing roller deposited on the coating roller. The metered developing liquid is directly coated on, or transferred to, the developer carrier, forming a uniform thin layer on the developer carrier.

In the conventional coating device described above, the developing liquid is directly transferred from the coating roller to the developer carrier, as stated above. Therefore, the problem with the developing device, in which the coating roller and developer carrier rotate in contact with each other, is that the coating roller is likely to shave off the developer carrier with its uniform cell pattern, accelerating exhaustion of and damage to the developer carrier.

It follows that the developer carrier included in the developing device of the type described must satisfy the following conditions (1) through (5).

(1) The hardness of the developer carrier is low enough to form a preselected nip for development between the developer carrier and the image carrier.

(2) At least the surface of the developer carrier is conductive and capable of being applied with a bias.

(3) At least the surface of the developer carrier has mechanical strength great enough to resist wear ascribable to friction, which acts between the developer carrier and the coating roller.

(4) At least the surface of the developer carrier has mechanical strength great enough to resist wear ascribable to friction, which acts between the developer carrier and the cleaning blade.

(5) The surface of the developer carrier is smooth enough to uniformly coat the developing liquid on the image carrier.

The above conditions (3) and (4) relate to the durability of the developer carrier and therefore determines the life of the same. In the conventional coating device in which the photogravure roller or similar coating roller with a carved surface rotates in direct contact with, e.g., a developing roller, the life of the developing roller corresponds to only 50,000 prints or so even if it is covered with a conductive PFA tube, as determined by a continuous image forming test. Further, the material applicable to the developer carrier is limited due to the above severe conditions required of the developer carrier. It is therefore difficult to provide the developer carrier with durability that satisfies the conditions (1) through (5).

To solve the above problem, there has been proposed. a coating device including an intermediate roller (or belt) interposed between a coating roller (or belt) or coating member and a developing roller (or belt) or subject member to be coated. In this coating device, a developing liquid is transferred from the coating roller to the developing roller via the intermediate roller, i.e., the coating roller does not contact the developing roller. The developing roller is therefore free from wear and damage ascribable to the contact thereof with the coating roller and achieves a longer life.

In a developing system of the type developing a latent image formed on an image carrier with a developing liquid coated on a developing roller or developer carrier, as stated above, whether or not the liquid can stably form a thin layer on the developing roller is the key to high image quality. However, when the intermediate roller or intermediate member is formed of an insulative material, the developing liquid cannot form a uniform thin layer on the developer carrier due to the frictional charging of the surface of the intermediate roller.

In the developing device with the coating device described above, a sufficient nip for development should preferably be formed between the developing roller and the image carrier in order to stabilize image quality. For this purpose, the developer carrier may include an elastic layer of low hardness such that the developer carrier deforms when pressed against the image carrier, thereby forming the desired nip. However, the developer carrier suffers from permanent set if left in pressing contact with the image carrier when the developing device is not operated. The permanent set causes the amount of the developing liquid to deposit on the image carrier and therefore image density to vary.

Still another problem with the developing device of the type described is that when impurities are introduced in the developing liquid stored in the coating device, stripes extend from the impurities over the circumference of the developer carrier, lowering image quality. Moreover, if such impurities are harder than any one of the coating member, intermediate member and developer carrier, then the former scratches the surface of the latter and thereby reduces the life or the same.

SUMMARY OF THE INVENTION

It is an object of the present invention to provide a developing liquid coating device capable of extending the life of a developer carrier, a developing device including the same, and an image forming apparatus including the developing device.

It is another object of the present invention to provide a developing liquid coating device capable of causing a developing liquid to form a uniform thin layer on a developer carrier, a developing device including the same, and an image forming apparatus including the developing device.

It is a further object of the present invention to provide a developing liquid coating device capable of uniformly coating a developing liquid on a developer carrier until the end of the developer carrier, a developing device including the same, and an image forming apparatus including the developing device.

A device for coating a developing liquid of the present invention includes a coating member rotatable with the developing liquid deposited thereon in a preselected amount. An intermediate member has a surface contacting the surface of the coating member and movable at the same speed and in the same direction as the surface of the coating member. Also, the surface of the intermediate member contacts the surface of a subject member to be coated and movable in the opposite direction to the surface of the subject member.

BRIEF DESCRIPTION OF THE DRAWINGS

The above and other objects, features and advantages of the present invention will become more apparent from the following detailed description taken with the accompanying drawings in which:

FIG. 34 shows a relation between the surface roughness of an intermediate roller included in a coating device, which forms part of a developing device included in the illustrative embodiment, and a roller life;

DESCRIPTION OF THE PREFERRED EMBODIMENTS

Preferred embodiments of the image forming apparatus in accordance with the present invention will be described hereinafter.

First Embodiment

Figure 1:
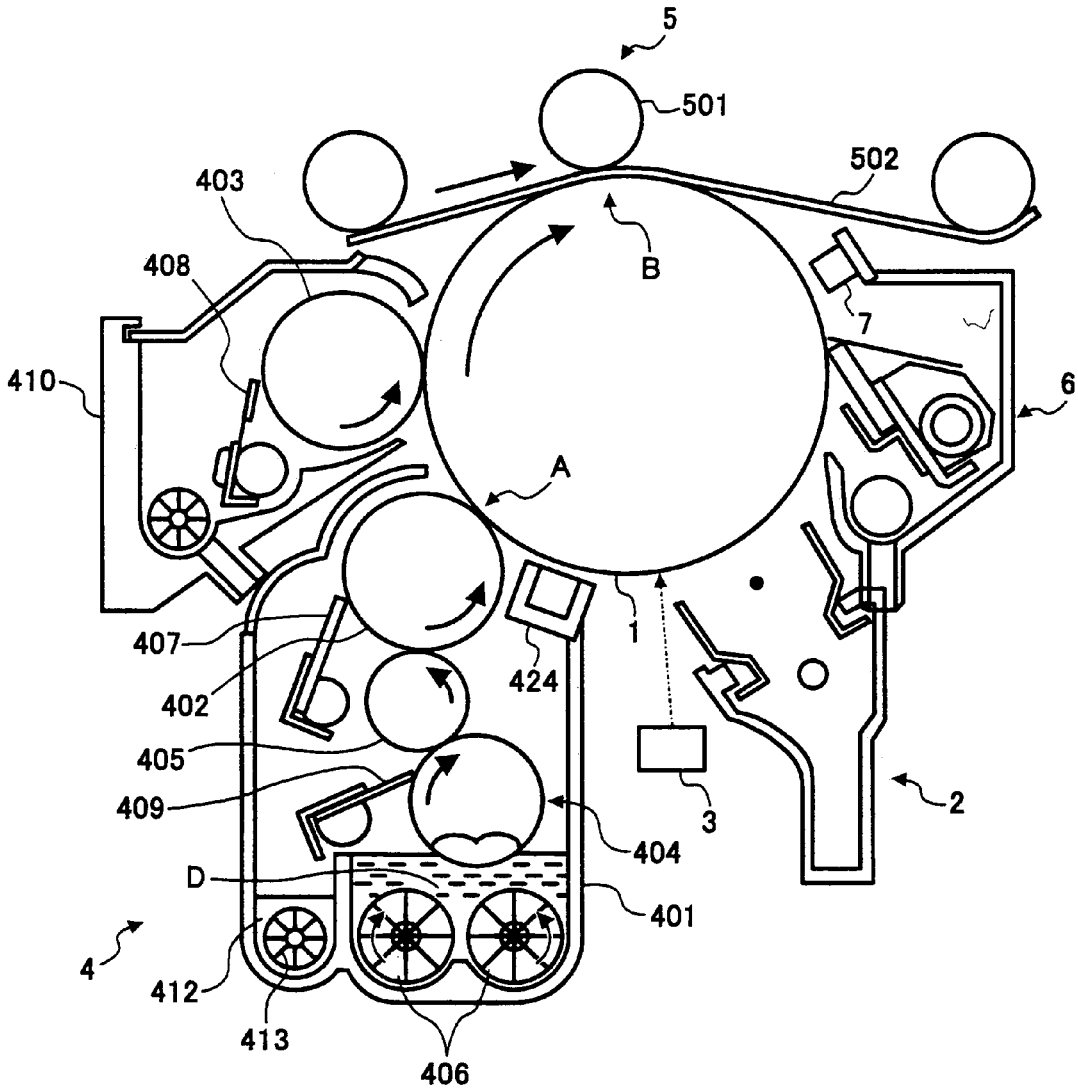
FIG. 1 is a view showing major part of a first embodiment of the image forming apparatus in accordance with the present invention.

Referring to FIG. 1 of the drawings, an image forming apparatus embodying the present invention is shown and implemented as an electrophotographic copier by way of example. As shown, the copier includes an image carrier implemented as a photoconductive drum 1. Arranged around the drum 1 are various image forming means including a charger 2, an optical writing unit 3, a developing device 4, an image transferring device 5, and a cleaning device 6. The drum 1 may be formed of amorphous silicon (a-Si), organic photoconductor (OPC) or similar material. The charger 2 may be implemented as, e.g., a charge roller. The optical writing unit 3 may include an LED (Light Emitting Device) array or laser optics.

The copier with the above construction forms an image by reversal development, as will be described hereinafter. A motor or similar drive means, not shown, causes the drum 1 to rotate at constant speed in a direction indicated by an arrow in FIG. 1. The charger 2 uniformly charges the surface of the drum 1, which is in rotation, in the dark. The optical writing unit 3 scans the charged surface of the drum 1 with a light beam in accordance with image data, thereby forming a latent image representative of a document image. When the latent image formed on the drum 1 is brought to a developing zone A, the developing device 4 develops the latent image with a developing liquid to thereby produce a corresponding toner image.

A bias for image transfer is applied to an image transfer roller 501 included in the image transferring device 5, which is located at an image transferring zone B. The image transfer roller 501 applied with the bias transfers the toner image from the drum 1 to a belt or intermediate image transfer body 502, which forms part of the image transferring device 5. This image transfer will be referred to as primary image transfer. The toner image is then transferred from the belt 502 to a sheet, OHP film or similar recording medium at a secondary image transferring zone by secondary image transferring means, although not shown specifically. A fixing unit, not shown, fixes the toner image on the sheet. Finally, the sheet with the fixed toner image is driven out of the copier as a print.

A quenching lamp 7 dissipates potential left on the drum 1, i.e., discharges the drum 1 after the primary image transfer. Also, the cleaning device 6 removes the toner left on the drum 1 after the primary image transfer. While the image transferring device 5 is implemented as a roller in the illustrative embodiment, it may alternatively be implemented by corona discharge, adhesion transfer or thermal transfer, if desired. The fixing unit may use thermal transfer or fixation using a solvent, ultraviolet rays or pressure by way of example.

In the illustrative embodiment, the developing liquid used to develop a latent image is a highly viscous and dense developing liquid different from a conventional low viscosity (about 1 cSt), low density (about 1%) developing liquid using Isopar (trade name) available from EXXON as a carrier liquid. The viscosity of the developing liquid used in the illustrative embodiment should preferably be between 50 mPa.S and 10,000 mPa.S while the density or toner content should preferably be between 5% and 40%. As for the carrier liquid, use may be made of, e.g., normal paraffin, Isopar (trade name) available from EXXON, plant oil, mineral oil or similar highly insulative oil. The developing liquid may be either volatile or nonvolatile in accordance with the purpose. Toner grains contained in the developing liquid may have any suitable grain size between the order of submicrons and about 6 microns.

The developing device 4, which characterizes the illustrative embodiment, includes a reservoir 401 storing a developing liquid D. A developing roller 402 is rotatably disposed in the reservoir 401 while a sweep roller 403 is rotatably disposed in a casing 410. A coating device for coating the developing liquid D on the developing roller, or subject member to be coated, 402 includes a coating roller 404, an intermediate roller or intermediate member 405, and a screw 406. The surface of the coating roller 404 is carved with a uniform pattern. The intermediate roller 405 coats the developing liquid on the developing roller 402 while the screw 406 conveys the developing liquid D while agitating it. Cleaning, members 407 and 408 are held in contact with the developing roller 402 and sweep roller 403, respectively, and each is implemented as a blade or a roller formed of metal or rubber.

In the coating device, the intermediate roller 405 bifunctions as a doctor roller for removing excess part of the developing liquid D from the coating roller 404 to thereby regulate the amount of the liquid D deposited on the roller 404. The developing liquid D coated on the coating roller 404 is transferred to the intermediate roller 405 in an amount metered by a doctor blade or metering member 409.

Figure 2:
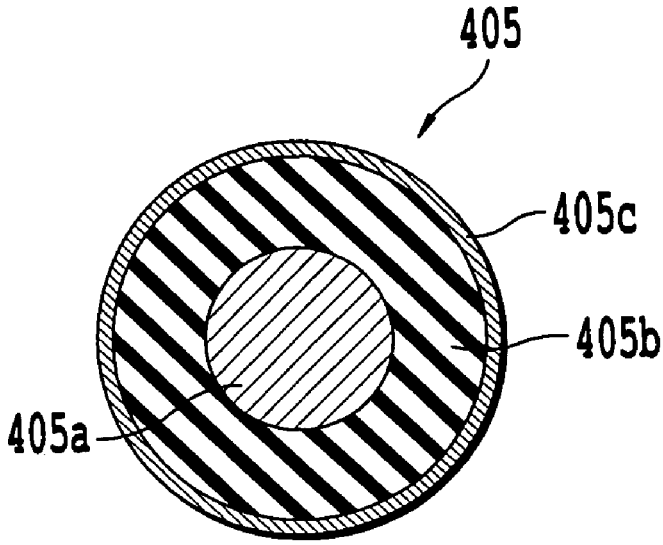
FIG. 2 is a section showing an intermediate roller included in a coating device that forms part of a developing device included in the illustrative embodiment.

As shown in FIG. 2, the intermediate roller 405 is made up of a metallic core 405*a*, an elastic layer 405*b* formed on the core 405*a*, and a smooth layer 405*c* formed on the elastic layer 405*b*. The elastic layer 405*b* may be formed of urethane rubber or similar material that does not swell with or dissolve in the carrier liquid or the developing liquid.

Figure 3:
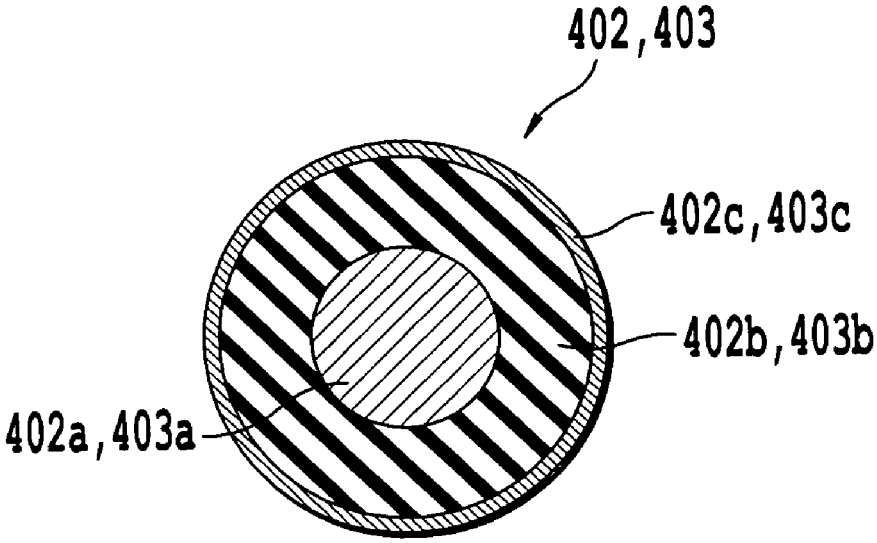
FIG. 3 is a section showing a developing roller and a sweep roller also included in the developing device.

As shown in FIG. 3, the developing roller 402 is made up of a metallic core 402*a*, an elastic layer 402*b* formed on the core 402*a*, and a conductive layer 402*c* formed on the elastic layer 402*b*. Likewise, the sweep roller 403 is made up of a metallic core 403*a*, an elastic layer 403*b* formed on the core 403*a*, and a conductive layer 403*c* formed on the elastic layer 403*b*. The elastic layers 402*b* and 403*b* may be formed of urethane rubber. The elastic layers 402*b* and 403*b* should preferably have rubber hardness of 50° or less in terms of JIS (Japanese Industrial Standards)-A scale, so that the developing roller 402 and sweep roller 403 can efficiently form a nip for development and a nip for removal, respectively, between them and the drum 1.

The elastic layers 402*b* and 403*b* of the developing roller 402 and sweep roller 403, respectively, may be formed of a material other than urethane rubber so long as it does not swell with or dissolve in the carrier liquid or the developing liquid. Moreover, the elastic layers 402*b* and 403*b* may be simply elastic if the developing roller 402 and sweep roller 403 each have a conductive surface and do not swell with or dissolve in the carrier liquid or the developing liquid and if the internal layers do not contact the liquid. If the elastic layers 402*b* and 403*b* are formed of an insulator, then a bias voltage for development and a bias voltage, respectively, must be applied from the surface of the developing roller 402 and that of the sweep roller 503 instead of from the cores 402*a* and 403*a*.

In another specific configuration for efficiently forming the nips between the developing roller 402 and sweep roller 403 and the drum 1, the rollers 402 and 403 are formed of a rigid material while an elastic layer is formed on the drum 1. The drum 1 with elasticity may be replaced with an endless belt, if desired. The surface of the developing roller 402 and that of the sweep roller 403 are coated, covered with tubes or otherwise processed to have surface roughness Rz of 3 $\mu$m or less.

Referring again to FIG. 1, when the developing roller 402 and sweep roller 403 are pressed against the drum 1 by adequate pressure, the elastic layers 402*b* and 403*b* elastically deform and respectively form the development nip and removal nip between the rollers 402 and 403 and the drum 1. Particularly, the, development nip causes the toner of the developing liquid to be propagated to and deposited on the drum 1 due to an electric field formed in the developing zone A, guaranteeing a preselected developing time.

Further, by controlling the pressure to act between each of the developing roller 402 and sweep roller 403 and the drum 1, it is possible to control the width of each nip in the direction in which the surface of the roller moves. The nip width is selected to be greater than the product of the linear velocity of each roller 402 or 403 and a development time constant. A development time constant refers to a period of time necessary for the amount of development to saturate and produced by dividing the minimum necessary nip width by a process speed. For example, if the minimum necessary nip width is 3 mm while the process speed is 300 mm/sec, then the development time constant is 10 msec.

While the developing device 4 is in operation, the developing liquid is transferred from the coating roller 404 to the developing roller 402 via the intermediate roller 405, forming a thin developer layer on the developing roller 402. In the illustrative embodiment, the thickness of the developer layer on the developing roller 402 is selected such that the toner contains a pigment by an amount of 3 $\mu$g or above, but 60 $\mu$g or below, for an area of 1 $cm^2$. For this purpose, the developer layer on the developing roller 402 is made as thin as 3 pin to 10 $\mu$m. If the pigment content of the toner deposited on the developing roller 402 for an area of 1 cm.sup.2 is less than 3 $\mu$g, then it is likely that an amount of pigment great enough to insure sufficient image density cannot be migrated to an image portion formed on the drum 1. Also, if the pigment content is greater than 60 $\mu$g, it is likely that the toner remains on the background of the drum 1 in an excessive amount alter the development of a latent image, obstructing the removal of toner assigned to the sweep roller 403.

The developer layer so formed on the developing roller 402 contacts the drum 1 when brought to the nip for development between the drum 1 and the developing roller 402, so that the toner is transferred from the roller 402 to a latent image or image portion formed on the drum 1. However, the toner does not deposit on the background or non-image portion of the drum 1, but moves toward the developing roller 402 due to an electric field formed by a difference between the bias for development and the potential of the drum 1.

If the toner deposited on the background of the drum 1 partly fails to return to the surface of the developer 402 and remains on the background, then the toner produces fog in the resulting image. The sweep roller 403 sweeps such toner causative of fog (fog toner hereinafter). As shown in FIG. 1, the sweep roller 403 is pressed against the drum 1 at a position downstream of the developing roller 402 in the direction of rotation of the drum 1 in such a manner as to sandwich the toner image or developer layer formed on the drum 1 between it and the drum1. The surface of the sweep roller 403 moves at substantially the same speed as the surface of the drum 1 in contact with the drum 1, thereby removing the fog toner from the background of the drum 1.

Figure 4:
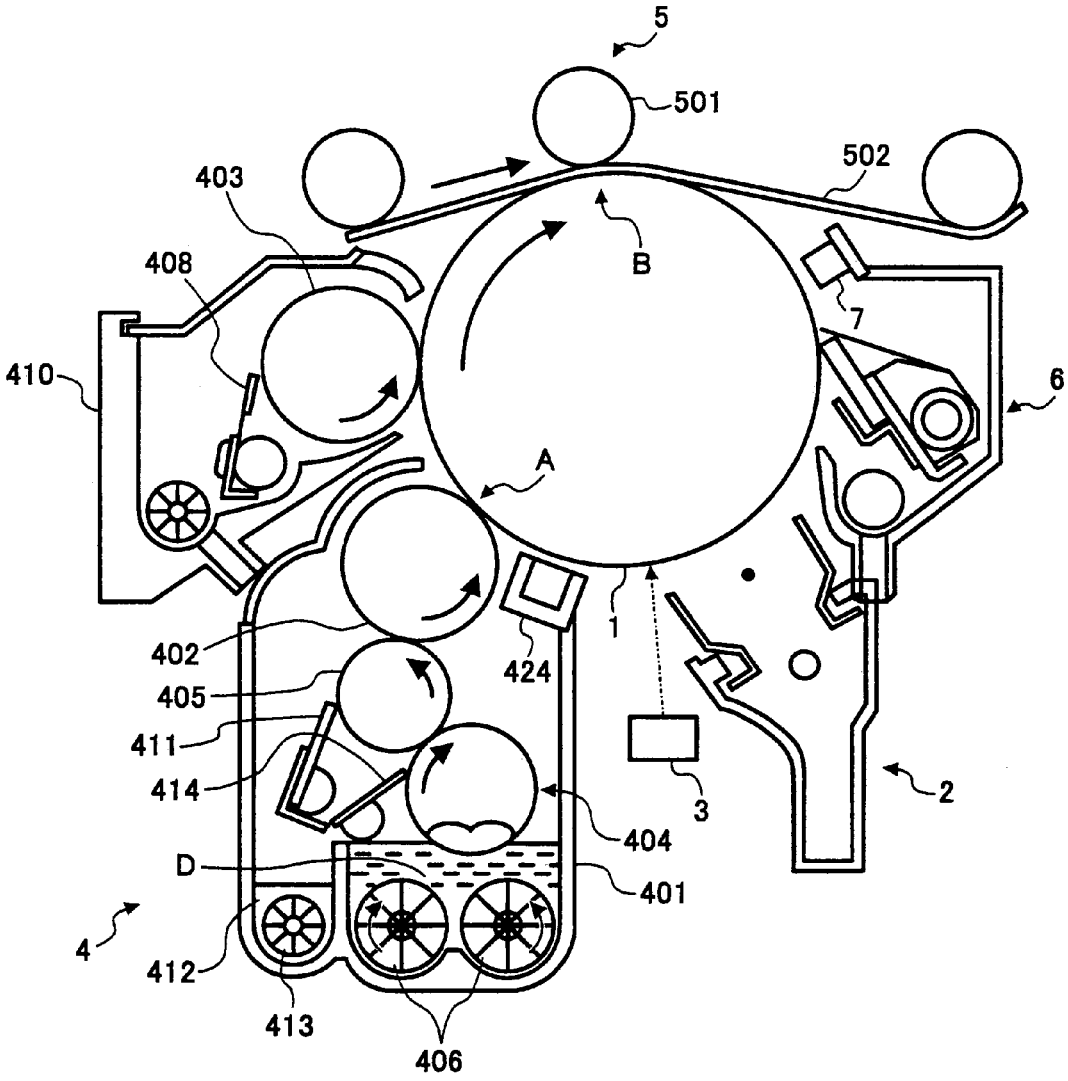
FIG. 4 shows another specific configuration of the illustrative embodiment.

The cleaning member or blade 401 removes the toner left on the developing roller 402 after the development of the latent image so as to obviate ghosts. Alternatively, as shown in FIG. 4, there may be removed the toner transferred from the developing roller 402 to the intermediate roller 405, which rotates in the direction counter to the developing roller 402. More specifically, in FIG. 4, a cleaning member or blade 411 is held in contact with the intermediate roller 405 and removes the toner transferred from the developing roller 402 to the intermediate roller 405.

The cleaning member or blade 408 removes the developing liquid removed by and deposited on the sweep roller 403 in order to maintain the sweeping function required of the sweep roller 403.

The developing liquid removed from the rollers 402 through 405, as stated above, is collected in a temporary storage 412 adjoining the reservoir 401, as illustrated. A screw or agitating means 413 is disposed in the temporary storage 412 for conveying the developing liquid so collected in the storage 412 to a toner content adjusting section not shown. After the toner content of the developing liquid has been adjusted by the toner content adjusting section, the developing liquid is returned to the reservoir 401 and used again. Toner content sensing means and liquid level sensing means, not shown, are also disposed in the temporary storage 412 for respectively sensing the toner content and the liquid level of the developing liquid collected in the storage 412. The toner content adjusting section replenishes a fresh developing liquid and a carrier in accordance with the outputs of the above sensing means, thereby providing the collected developing liquid with the preselected toner content. In the illustrative embodiment, the developing liquid is fed to the reservoir 401 in a slightly greater amount than it is consumed. As a result, the developing liquid overflowed the reservoir 401 is returned to the temporary storage 412 and therefore constantly circulated.

Figure 5:
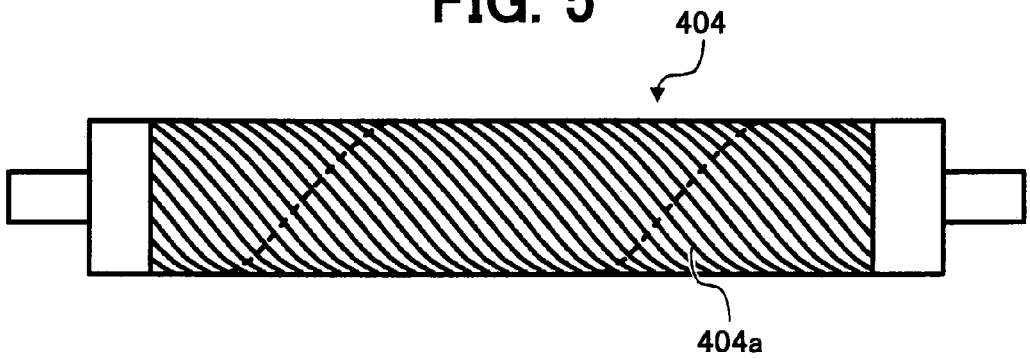
FIG. 5 is a front view showing a specific configuration of a coating roller included in the coating device and implemented as a photogravure roller.
Figure 6A:
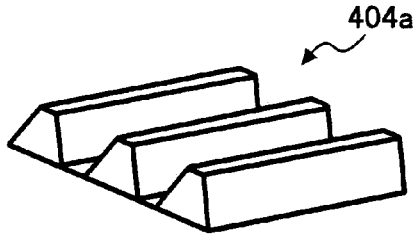
FIGS. 6A through 6C are enlarged isometric views each showing a particular cell pattern formed on the coating roller.
Figure 6B:
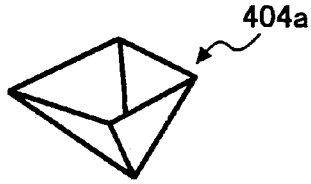
Figure 6C:
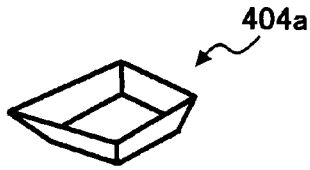
Figure 7:
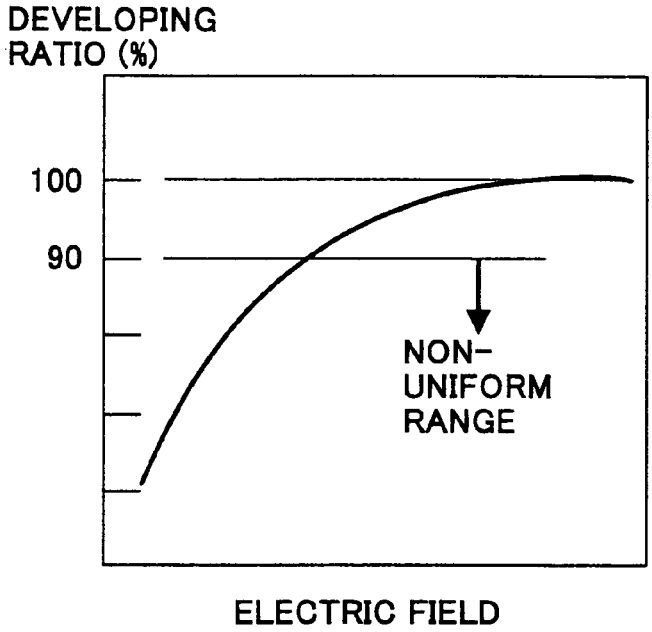
FIG. 7 is a graph showing a relation between the strength of an electric field for development and a development ratio.

The density or a toner image formed on the drum 1 is determined by the thickness of the developing liquid or developer layer deposited on the developing roller 402. In light of this, as shown in FIG. 5, the coating roller 404 is implemented as, e.g., a so-called photogravure roller whose surface is formed with cells or recesses 404*a* in a regular pattern. FIGS. 6A, 6B and 6C each show a particular configuration of the cells 404*a*. As shown, the cells 404*a* may be implemented as oblique lines (FIG. 6A), pyramids (FIG. 6B) or lattices (FIG. 6C) by way of example. The oblique lines shown in FIG. 6A are particularly preferable because they promote desirable image transfer. Excess part of the developing liquid deposited on the coating roller 404 is squeezed off at the position where the roller 404 contacts the intermediate roller 405. Consequently, the developing liquid is deposited on the coating roller 404 in an amount accurately measured by the recesses 404*a*.

The developing liquid so deposited on the coating roller 404 is transferred to the developing roller 402 by way of the intermediate roller 405, forming a uniform, thin developer layer. The surface of the intermediate roller 405 moves at the same peripheral speed and in the same direction as the surface of the coating roller 404 while moving in the direction counter to the surface of the developing roller 402, thereby forming the uniform, thin developer layer on the developing roller 402.

More specifically, the thin developer layer has the same pattern as the cells 404*a* of the coating roller 404 just after it has been transferred from the coating roller 404 to the intermediate roller 405. At this instant the surface of the intermediate roller 405 is moving in the direction counter to the surface of the developing roller 402. As a result, the developer layer transferred to the developing roller 402 is drawn out and leveled due to a difference in linear velocity between the intermediate roller 405 and the developing roller 402, forming the uniform, thin layer on the roller 402.

Assume that the photogravure roller or similar coating roller 404 formed with the cells 404*a* and the developing roller 402 directly contact each other. Then, the cells 404*a*, eliding on the surface of the developing roller 402, wear and damage the surface of the roller 402. More specifically, the surface of the developing roller 402 and that of the coating roller 404 move in opposite directions to each other, so that the roller 402 contacts the cells 404*a* with a noticeable difference in linear velocity. As a result, the surface of the developing roller 402 is damaged, reducing the life of the roller 402.

By contrast, in the illustrative embodiment, the developing liquid is fed from the coating roller 404 to the developing roller 402 by way of the intermediate roller 405, as stated above. The surface of the developing roller 402 is therefore prevented from being worn out or damaged by the cells 404*a* of the coating roller 404. Although the intermediate roller 405 contacts the developing roller 402 and rotates in the direction counter to the roller 402, the roller 405 does not damage the surface of the roller 402 because its surface is smooth. This successfully frees the developing roller 402 from mechanical stress for thereby extending the life of the roller 402.

While the intermediate roller 405 contacts the coating roller 404, the surface of the roller 405 and that of the roller 404 move at the same speed in the same direction, as seen at the position where they contact each other. Therefore, mechanical stress exerted by the coating roller 404 on the intermediate roller 405 is so small, the surface of the roller 405 is not worn out or damaged by the cells 404*a* of the roller 404.

The metering member for metering the developing liquid deposited on the coating roller 404 is generally implemented as the doctor blade 409 as in the illustrative embodiment or as a doctor roller. While the coating device using the doctor blade 409 is relatively simple in construction and can be reduced in size, the edge of the doctor blade 409 contacting the coating roller 404 is apt to wear. Further, impurities introduced in the developing liquid accumulate between the edge of the doctor blade 409 and the surface of the coating roller 404, making the developer layer formed on the roller 404 irregular. Although the coating device using a doctor roller is free from the above problems, such a coating device is bulky.

In light of the above, in the illustrative embodiment, the intermediate roller 405 may be configured to bifunction as a doctor roller. More specifically, the intermediate roller 405 may be pressed against the coating roller 404 by pressure high enough to coat the developing liquid on the roller 404 by an adequately metered amount.

FIG. 4 shows a specific configuration of the coating device in which the intermediate roller 405 bifunctions as a doctor roller and therefore makes the doctor blade 409, FIG. 1, needless. As shown, a blade 414 for removing impurities is positioned in the space that is occupied by the doctor blade 409 in FIG. 1. The blade 414, configured to remove impurities contained in the developing liquid and deposited on the coating roller 404, is held in contact with the coating roller 404 with lower pressure than the doctor blade 409.

As stated above, in the coating device shown in FIG. 4, impurities are prevented from accumulating between the edge of the blade 414 and the surface of the coating roller 404, so that the developing liquid can be uniformly coated on the roller 404. Further, the impurities are leveled at the nip between the coating roller 404 and the intermediate roller 405 positioned downstream of the blade 414 in the direction of rotation of the developing roller 404. In this manner, the intermediate roller 405 bifunctions as a doctor roller and implements a small-size coating device free from irregular coating.

In FIG. 4, the cleaning member 407, FIG. 1, assigned to the developing roller 402 is omitted while the cleaning member 411 is held in contact with the intermediate roller 405, as stated earlier. In this condition, the developing liquid left on the developing roller 402 after development is transferred to the intermediate roller 405 and then removed from the intermediate roller 405 by the cleaning member 411. Because the cleaning member 407 is absent, the surface of the developing roller 402 is free from wear and damage ascribable to the cleaning member 407 and therefore achieves an extended life.

The surface of the intermediate roller 405 should preferably uniformly contact the surface of the coating roller 404 in the axial direction. This is why the intermediate roller 405 includes the previously stated elastic layer 405*b*. Also, the intermediate roller 405 must be pressed against the coating roller 404 by more than certain pressure when required to bifunction as the metering member. More specifically, in the illustrative embodiment, the volume of the cells 404*a* formed in the coating roller 404 determines the amount of the developing liquid to deposit on the roller 404. Therefore, if the pressure acting between the intermediate roller or metering member 405 and the coating roller 404 is short, then the developing liquid is likely to pass through the nip between the surface of the roller 404 except for the cells 404*a* and the surface of the roller 405. In such a case, the amount of the developing liquid actually deposited on the coating roller 404 is short of the expected amount determined by the volume of the cells 404*a*, resulting in short image density.

The amount of the developing liquid to pass through the nip between the surface of the coating roller 404 except for the cells 404*a* and the surface of the intermediate roller 405 is dependent on the linear velocity of the intermediate roller 405 and coating roller 404 and the viscosity of the developing liquid. For example, the amount increases with an increase in the viscosity of the developing liquid. It follows that when the viscosity of the developing liquid varies due to, e.g., varying ambient temperature, the amount of the developing liquid to deposit on the coating roller 404 becomes irregular.

To solve the above problem, in the illustrative embodiment, the intermediate roller 405 is pressed against the coating roller 404 by pressure as high as 0.2 Mpa. In this condition, the intermediate roller 405 bifunctions as a doctor roller capable of efficiently metering the developing liquid to deposit on the coating roller 404.

In principle, the coating roller 404 and intermediate roller 405 each should be a true circle in cross-section so as not to oscillate. In practice, however, mechanical accuracy available with this kind of rollers is limited. In the illustrative embodiment, the elastic layer 405*b*, FIG. 2, of the intermediate roller 405 absorbs the oscillation of the roller 405, insuring the stable contact of the roller 405 with the coating roller 404.

The elastic layer 405*b* of the intermediate roller 405 should preferably have rubber hardness of 70° or below in terms of JIS-A scale.. Rubber hardness higher than 70° makes it difficult for the intermediate roller 405 to uniformly contact the coating roller 404. If the intermediate roller 405 is excessively pressed against the surface of the coating roller 404, then energy necessary for the elastic layer 405*b* to deform increases and requires the core 405*a*, which receives the load, to be made thick and rigid more than necessary. Rubber hardness lower than 30° makes it difficult to implement pressure that allows the intermediate member 405 to bifunction as the metering member, so that the elastic layer 405*b* must noticeably deform and is therefore reduced in life. For these reasons, in the illustrative embodiment, the elastic layer 405*b* is provided with rubber hardness of 40° in terms of JIS-A scale.

The elastic layer 405*b* of the intermediate roller 405 may be formed of urethane rubber or similar rubber. Rubber, however, generally has a large coefficient of friction and generates extremely high frictional resistance at the position where the elastic layer 405*b* contacts the developing roller 402. Such frictional resistance not only increases the load on a driveline assigned to the intermediate roller 405 and developing roller 402, but also noticeably reduces the life of the rollers 405 and 402. This is why the smooth layer 405*c* implemented by a low-friction member covers the surface of the intermediate roller 405.

The smooth layer 405*c* may be implemented by PTFE, PFA, PVDF, PVF or similar fluorocarbon resin coated on the elastic layer 405*b* or a tube formed of fluorocarbon resin and covering the elastic layer 405*b*. In the illustrative embodiment, use is made of a 50 $\mu$m thick, PFA tube fitted on the elastic layer 405*b*. The developing roller 402 is also covered with a 50 $\mu$m thick, conductive PFA tube.

A continuous copy test was conducted with the coating device having the configuration shown in FIG. 4. The test showed that even after the output of images on 200,000 plain sheets, the developing roller 402 was free from damage ascribable to the mechanical stress described above, insuring desirable image quality. Further, when the photoconductive surface of the drum 1 was formed of a-Si, the mechanical strength and therefore the life of the drum 1 was enhanced more than when the above surface was formed of OPC.

The amount of the developing liquid to deposit on the developing roller 402 is determined by the volume of the cells 404*a* for a unit area and the liquid transfer ratio from the coating roller 404 to the developing roller 402, as stated above. In the illustrative embodiment, the coating roller 404 is provided with an adequate cell volume and pressed against the intermediate roller 405 by sufficient pressure, thereby preventing the amount of the developing liquid to deposit on the developing roller 402 from varying.

In the above condition, the transfer ratio of the developing liquid from the coating roller 404 to the developing roller 402 is expected to remain substantially constant if the properties of the developing liquid are fixed. However, if, e.g., the viscosity of the developing liquid varies due to varying ambient temperature, then the transfer ratio varies. As a result, the density of a toner image varies if development is effected under the same developing conditions as before.

When image density is controlled on the basis of the strength of an electric field, no problems arise if the electric field is strengthened for outputting a toner image with high density. However, when the electric field is weakened to output a toner image with low density, fine irregularities appear in the developer layer after development. More specifically, in the weak electric field, the behavior of toner grains contained in the developing liquid cannot be controlled. Therefore, at the time when the surface of the drum 1 and that of the developer 402 part from each other and cause the developing liquid to split, the two surfaces pull the split parts of the liquid away from each other. The resulting traces appear as irregularities in the developer layer after development. This kind of irregularities are conspicuous unless the development ratio is 90% or above. It follows that the control of image density relying on an electric field is not effective when the amount of the developing liquid coated varies to such a degree that the development ratio exceeds 10%.

Moreover, the amount of the developing liquid necessary for providing a toner image with adequate density is dependent on the smoothness of the recording medium. For example, a greater amount of developing liquid is necessary for a plain sheet than for a coated sheet or similar highly smooth recording medium in order to fill up the irregularities of the plain sheet.

Figure 9:
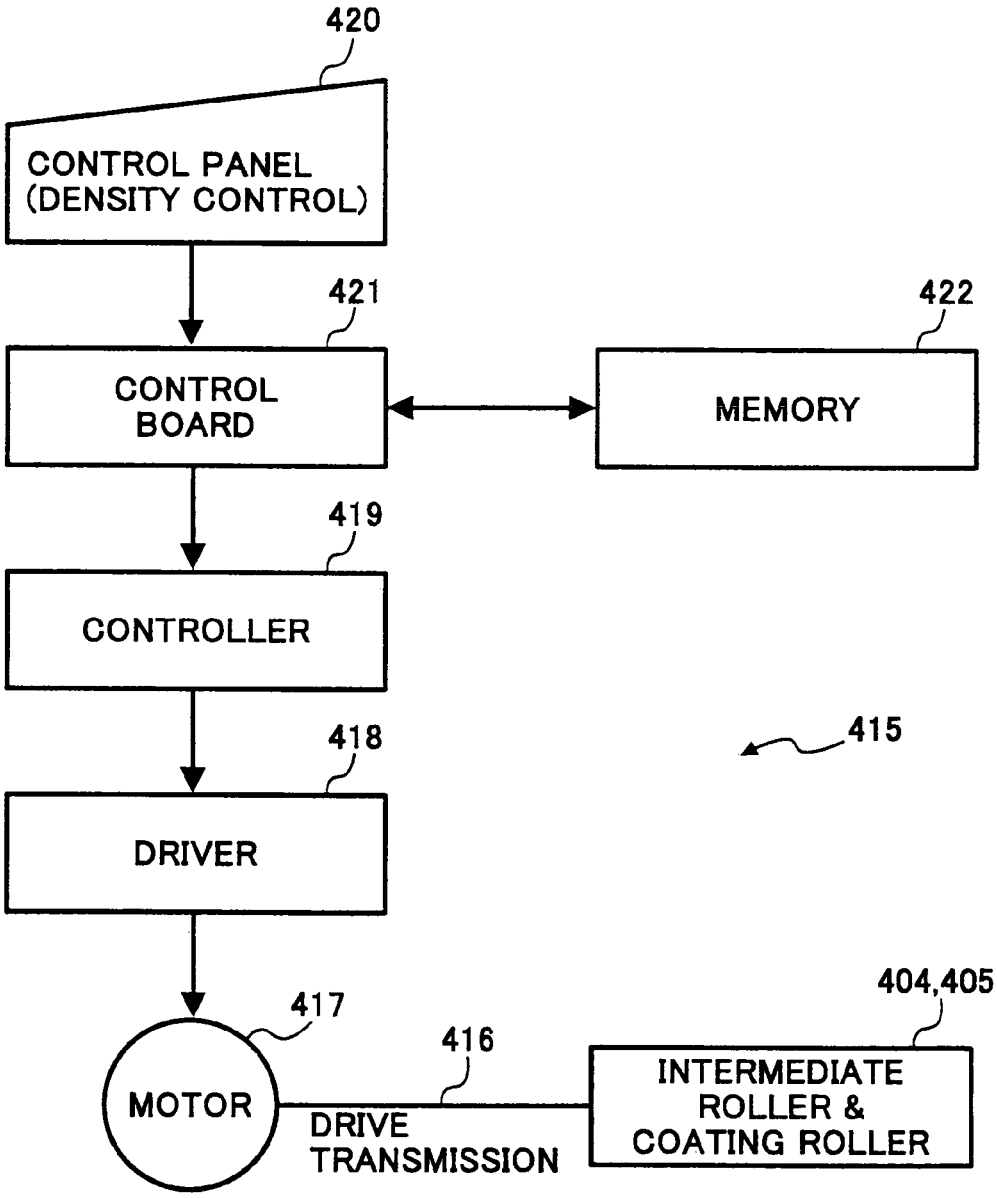
FIG. 9 shows a specific configuration of a drive mechanism capable of driving the coating roller and intermediate roller with a single drive source while maintaining their peripheral speeds equal to each other.

To solve the above problems, as shown in FIG. 9, the illustrative embodiment includes speed varying means 415 capable of varying the rotation speed of the coating roller 404 and that of the intermediate roller 405 while maintaining the two rotation speeds equal to each other. More specifically, the speed varying means 415 varies the rotation speed of the coating roller 404 and that of the intermediate roller 405 to thereby vary the relative moving speed of the surface of the intermediate roller 405 and that of the developing roller 402.

Figure 8:
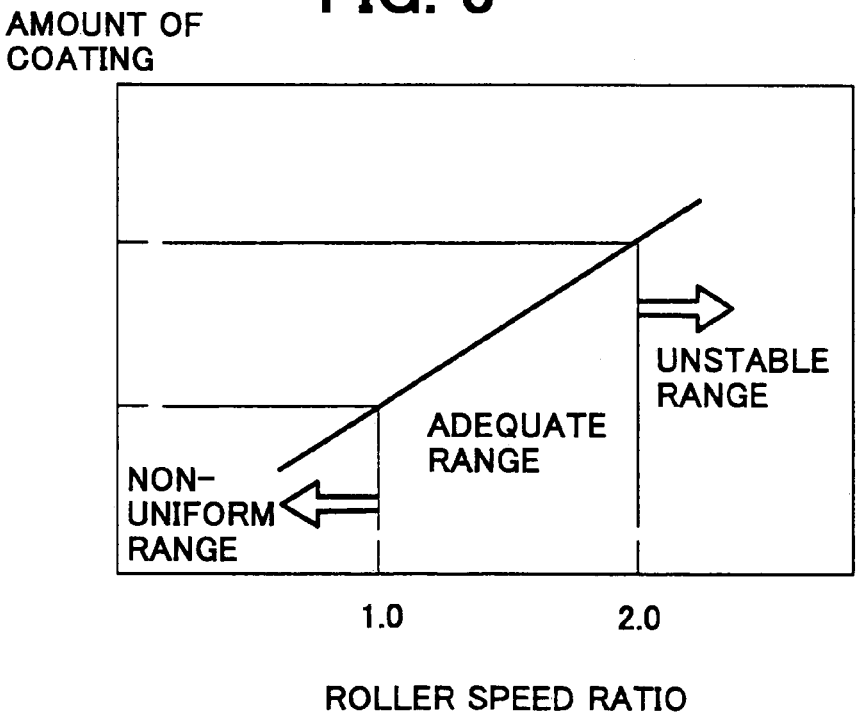
FIG. 8 is a graph showing a relation between a speed ratio between the developing roller and the intermediate roller and the amount of a developing liquid deposited on the developing roller.

As shown in FIG. 8, the amount of the developing liquid to be coated on the developing roller 402 by the intermediate roller 405 substantially linearly varies in proportion to the speed ratio between the developing roller 402 and the intermediate roller 405. The illustrative embodiment can therefore control the above amount by varying the speed ratio between the developing roller 402 and the intermediate roller 405.

As shown in FIG. 9 specifically, a driveline for driving the coating roller 404 and intermediate roller 405 includes drive transmitting means 416 implemented by, e.g., gears and a timing belt. A servo motor, stepping motor or similar motor 417 drives the coating roller 404 and intermediate roller 405 via the drive transmitting means 416. More specifically, a driver 418 drives the motor 417 at a rotation speed matching with a frequency signal and an A/D (Analog/Digital) signal, which a controller 419 outputs in accordance with the characteristics of the motor 417.

The controller 419 generates adequate signals in accordance with a request input from an operation panel 420 and a control board 421, thereby controlling the rotation speed of the intermediate roller 405 and that of the coating roller 404. Consequently, the linear speed ratio of the intermediate roller 405 and coating roller 404 to the developing roller 402 is controlled, so that the amount of the developing liquid to deposit on the developing roller 402 is controlled.

If only the peripheral speed of the intermediate roller 405 is varied, then a difference in peripheral speed occurs between the coating roller 404 and the intermediate roller 405 and causes the cells 404*a* of the roller 404 to scratch the surface of the roller 405, thereby reducing the life of the roller 405. It is therefore preferable to obviate the above difference as far as possible. This is why the illustrative embodiment varies the speed ratio between the developing roller 402 and the intermediate roller 405 while maintaining the peripheral speed of the coating roller 404 and that of the intermediate roller 405 the same. At this instant, a single drive source should preferably drive both of the coating roller 404 and intermediate roller 405. If the two rollers 404 and 405 each are driven by a respective drive source, then it is difficult to match the peripheral speed of the roller 404 and that of the roller 405 and therefore to obviate a difference between them.

Figure 10:
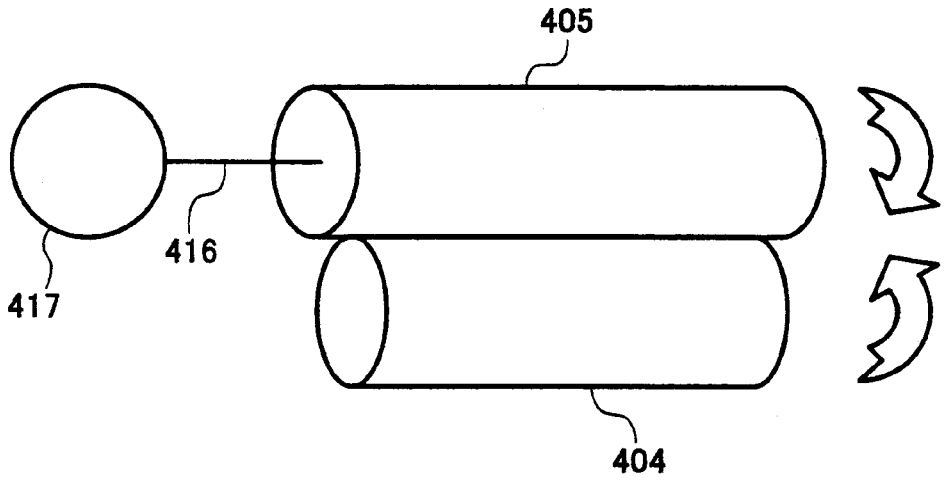
FIG. 10 shows a specific configuration of a drive mechanism confiqured to drive the intermediate roller with a single drive source while causing the coating roller to be rotated by the intermediate roller.

FIG. 10 shows a specific drive mechanism in which a single drive source drives both of the coating roller 404 and intermediate roller 405 while maintaining their peripheral speeds the same. As shown, the motor 417 causes the intermediate roller 405 to rotate in a direction indicated by an arrow via the drive transmitting means 416. The intermediate roller 405, in turn, causes the coating roller 404 to rotate in a direction indicated by an arrow with a frictional force acting therebetween. This successfully drives both of the rollers 404 and 405 at the same speed.

While the drive mechanism of FIG. 10 may be modified to cause the coating roller 404 to drive the intermediate roller 405 with a frictional force, this kind of scheme gives rise to the following problem. The intermediate roller 405 contacts the developing roller 402 to be coated with the developing liquid. This, coupled with the fact that the surface of the intermediate roller 405 moves counter to the surface of the developing roller 402, makes the rotation of the roller 405 unstable due to a load torque acting on the roller 405. In this respect, the drive mechanism of FIG. 10 frees the coating roller 404 from the load of the developing roller 402 for thereby insuring the stable drive of the rollers 404 and 405.

The developing liquid is made up of a solvent implemented by dimethylpolysiloxane oil or similar insulative liquid and toner grains densely dispersed in the liquid. Therefore, when the intermediate roller 405 causes the coating roller 404 to rotate with the intermediary of the developing liquid deposited on the roller 404, it is likely that the developing liquid functions as a lubricant and causes the roller 404 to slip on the roller 405. Particularly, when the intermediate roller 405 is driven at high speed, the slip of the coating roller 404 is apt to render the amount of the developing liquid to deposit on the roller 405 unstable.

Figure 11:
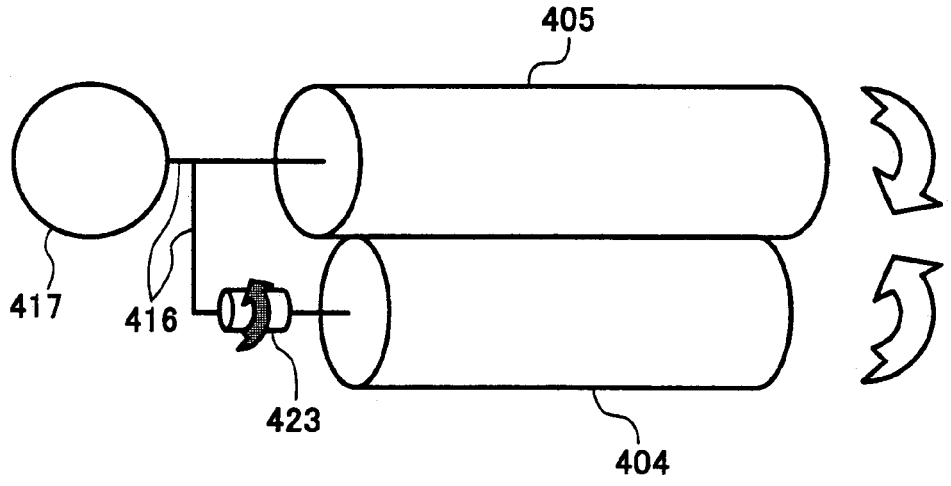
FIG. 11 shows a specific configuration of a drive roller configured to drive the coating roller and intermediate roller with a single drive source while obviating the slip of the intermediate roller.

FIG. 11 shows another specific configuration of the drive mechanism configured to obviate the slip of the intermediate roller 405 despite the use of a single drive source. As shown, the motor 417 drives not only the intermediate roller 405 but also the coating roller 404 via the drive transmitting means 416. The peripheral speed of the coating roller 404 is selected to be slightly lower than the peripheral speed of the intermediate roller 405, i.e., the former is lower than the latter by 2% to 5% in the illustrative embodiment. A one-way clutch 423 is included in part of the drive transmitting means 416 assigned to the coating roller 404. The one-way clutch 423 transmits the rotation of the motor 417 to the coating roller 404 in a direction indicated by an arrow, but does not transmit it to the roller 404 in the other direction.

In FIG. 11, when the motor 416 is rotated, the drive transmitting means 416 causes the intermediate roller 405 to rotate in the direction indicated by the arrow. So long as the coating roller 404 does not slip, the torque of the motor 417 is not transferred to the coating roller 404. Consequently, the intermediate roller 405 causes the coating roller 404 to rotate at the same speed as the roller 405 as in the drive mechanism of FIG. 10. More specifically, in this condition, the one-way clutch 423 causes the coating roller 404 to simply idle and follow the rotation of the intermediate roller 405, so that the coating roller 404 is free from a braking force.

On the other hand, when the coating roller 404 slips, it is not driven by the intermediate roller 405, but is caused to rotate by the drive transmitting means 416 at a slightly higher peripheral speed than the intermediate roller 405 in the direction indicated by the arrow. In this manner, the drive mechanism of FIG. 11 prevents the amount of the developing liquid coated from varying due to the slip of the coating roller 404. In addition, the drive mechanism reduces the difference in peripheral speed between the intermediate roller 405 and the coating roller 404, thereby protecting the surface of the roller 405 from damage ascribable to the above difference.

Assume a pair of rollers configured to move in the same direction at a position where they contact each other. Then, the amount of a liquid passing through the nip between the rollers and the split ratio of the liquid on the rollers after the passage of the liquid are generally dependent on the peripheral speed, geometric configuration of the surface and material constant of each roller as well as on the viscosity of the liquid. More specifically, it is well known that at the time when the coated liquid splits into two parts respectively deposited on the two rollers, the liquid unevenly splits in the form of rings along the circumference of the rollers.

To solve the above problem, the intermediate roller 405 of the coating device should preferably be so driven as to move in the opposite direction to the developing roller 402 where the former contacts the latter. However, in the illustrative embodiment, the coating roller 404 is formed with the cells 404*a* and therefore transfers the developing to the intermediate roller 405 in the same pattern as the cells 404*a*. Therefore, if the peripheral speed Vm of the intermediate roller 405 and the peripheral speed Vd of the developing roller 402 are the same ($Vm \leqq Vd$), then the developer layer identical in pattern with the cells 404*a* is directly transferred to the developing roller 402 in a size reduced in accordance with the speed ratio between the rollers 405 and 402. This makes it impossible for the developing liquid to form the desired uniform, thin developer layer on the developing roller 402.

In light of the above, in the illustrative embodiment, it is necessary to make the peripheral speed Vm of the intermediate roller 405 higher than the peripheral speed Vd of the developing roller 402 for thereby leveling the developer layer transferred to the roller 402 in the pattern of the cells 404*a*. While the amount of the developing liquid to deposit on the developing roller 402 substantially linearly varies in accordance with the ratio Vm/Vd, as shown in FIG. 8, the transfer of the developer layer to the roller 402 becomes unstable when the peripheral speed Vm is increased to about two times as high as the peripheral speed Vd. In the illustrative embodiment, the peripheral speed Vm of the intermediate roller 405 is selected to lie in the range of $Vd<Vm<2\times Vd$. In this condition, the intermediate roller 405 can level the developer layer transferred to the developing roller 402 in the pattern of the cells 404*a*, thereby forming the uniform, thin developer layer. In addition, the developer layer can be stably transferred to the developing roller 402 in a constant amount.

As stated above, in the illustrative embodiment, the intermediate roller 405 moves in the same direction as the coating roller 404, but moves in the opposite direction to the developing roller 402. The coating roller 404 and developing roller 402 therefore sandwich the intermediate roller 405 therebetween. In this condition, assume that the intermediate roller 405 contacts the coating roller 404 and developing roller 402 at a position downstream of a line virtually connecting the axes of the rollers 404 and 402 in the direction of rotation of the rollers 404 and 402. Then, a force tending to force the intermediate roller 405 away from the coating roller 404 and developing roller 402 acts on the intermediate roller 405. It is therefore likely that contact of the intermediate roller 405 with the coating roller 404 and developing roller 402 is unstable, preventing the developing liquid from being stably coated on the developing roller 402.

Figure 12:
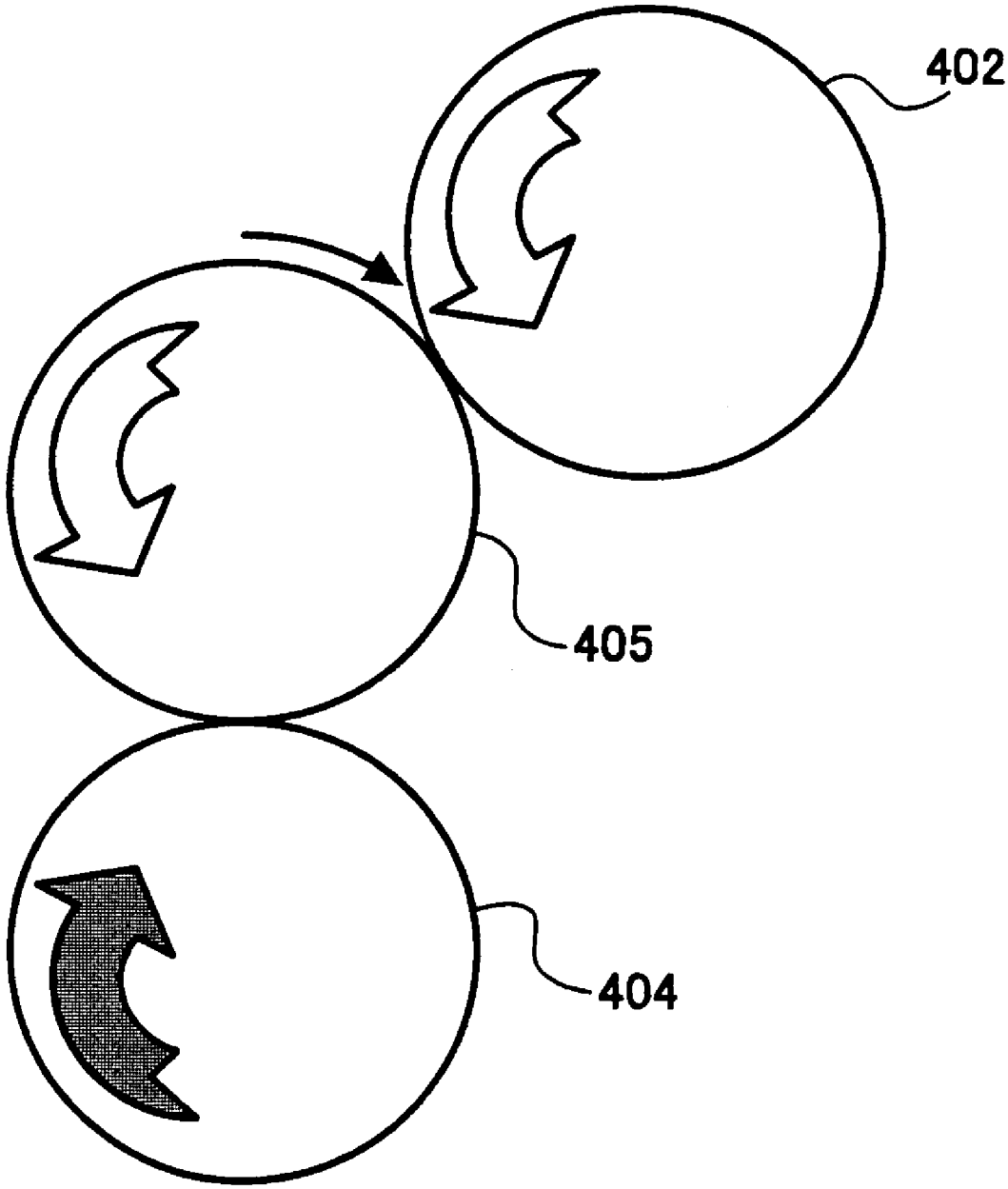
FIG. 12 shows the position of the intermediate roller with respect to the developing roller and coating roller.

FIG. 12 shows a solution to the above problem. As shown, the intermediate roller 405 contacts the coating roller 404 and developing roller 402 at a position upstream of the line virtually connecting the axes of the rollers 404 and 402. More specifically, a line tangential to the intermediate roller 405 and developing roller 402 is located at a position upstream of, in the direction of rotation of the roller 405, a line where a plane containing the axes of the rollers 404 and 405 and the surface of the roller 405 intersect each other and including the above line. In this configuration, a force tending to nip the intermediate roller 405 between the coating roller 404 and the developing roller 402 acts on the intermediate roller 405 due to the rotation of the rollers 404 and 402. Such a force stabilizes contact of the intermediate roller 405 with the coating roller 404 and developing roller 402, insuring stable coating of the developing liquid on the roller 402.

With the coating device described above, it is possible to correct the amount of the developing liquid coated on the developing roller 402 when it varies due to the variation of the transfer ratio of the liquid to the intermediate roller 405. This kind of variation is likely to occur when, e.g., temperature inside the image forming apparatus varies and causes the viscosity of the developing liquid to vary. It is also possible to adjust the amount of the developing liquid coated when the toner content of the developing liquid varies. In any case, by so controlling the amount of the developing liquid, it is possible to maintain image density constant. For this kind of control, it is necessary to sense image density. Usually, an optical sensor capable of optically sensing image density is used for this purpose.

The optical sensing means should preferably sense image density at the last image forming stage as far as possible in order to maintain image density constant. However, it is difficult to form an exclusive pattern image for image density sensing on a sheet carrying a toner image thereon. Generally, therefore, a pattern image is formed on the non-image area of the belt 502 or that of the drum 1, so that the sensor can sense the density of the pattern image, see FIG. 1.

If it suffices to maintain only the amount of the developing liquid to deposit on the developing roller 402 constant, then the toner content of the developer coated on the roller 402 should only be sensed. However, because developing and image transferring conditions also effect image density, it is more preferable to sense the density of the pattern image formed on the belt 502 or the drum 1 with the image density sensor.

Figure 13:
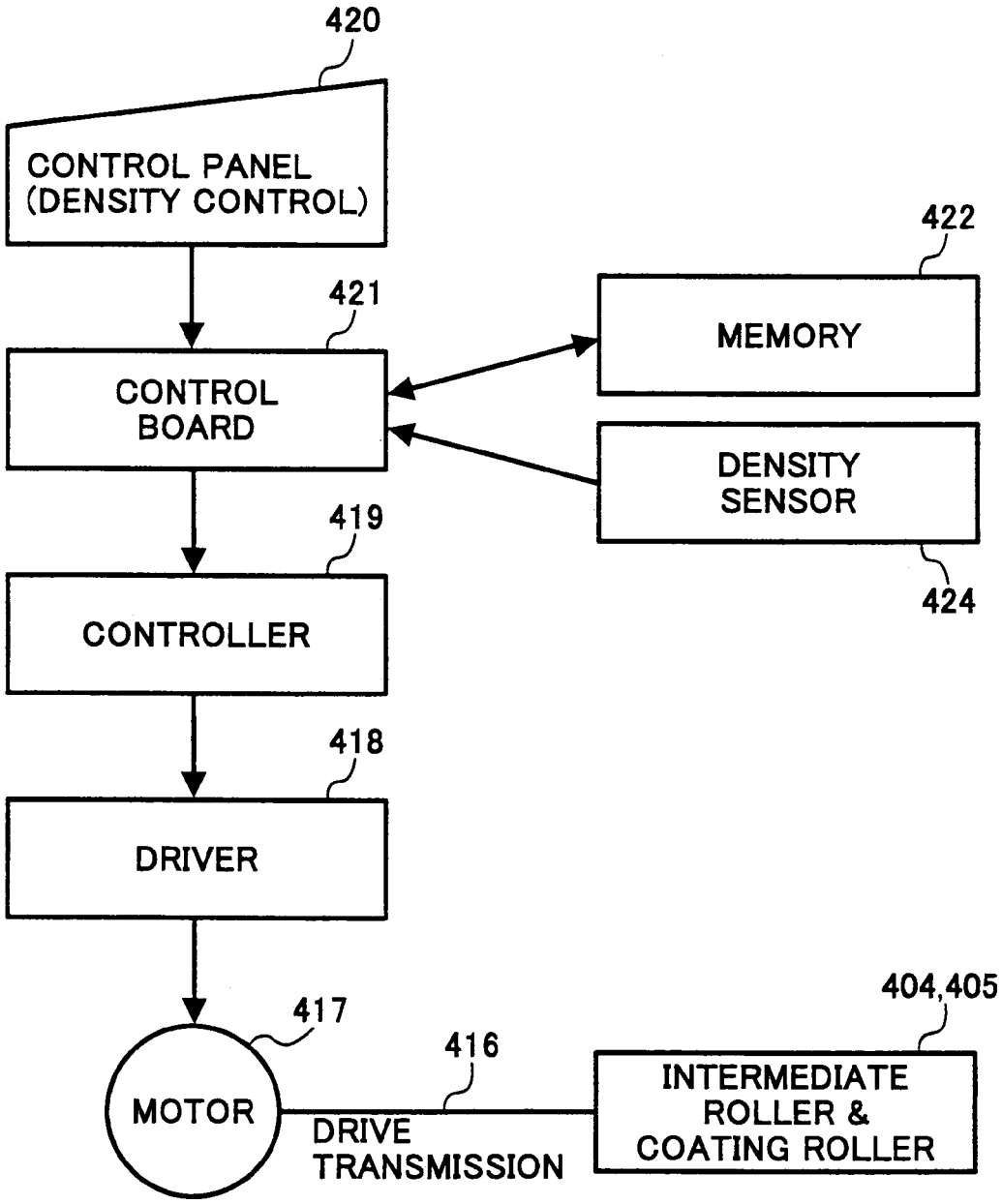
FIG. 13 shows a specific configuration of the coating device configured to maintain the density of a toner image constant by using a density sensor.

FIG. 13 shows another specific configuration of the coating device using a density sensor 424 for sensing the image density of the toner image formed on the belt 502 or the drum 1. The density sensor 424, implemented as an optical sensor by way of example, is positioned in the vicinity of the belt 502 or the drum 1. Information representative of image density is fed from the image sensor 424 to the control board 421 in addition to image density information input on the control panel 420 by the operator. The control board 421 compares the two kinds of image density information and then determines whether or not the amount of the developing liquid to deposit on the developing roller 402 should be varied. Subsequently, the control board 421 determines the rotation speed of the motor 417 in accordance with the result of the above decision and feeds signals to the controller 419 and driver 418, thereby controlling the motor 417. As for the above decision, adequate density information determined beforehand may alternatively be stored in a memory 422, in which case the control board 421 will compare the output of the density sensor 424 with the stored information.

In the copier described with reference to FIG. 1 or 4, a single developing device 4 adjoins the drum 1. If four developing devices storing yellow, magenta, cyan and black developing liquids, respectively, are arranged around the drum 1, then there can be implemented a color copier capable of forming a full-color toner image on the drum 1 as conventional. It is desirable with the color copier to control the amount of coating liquid by liquid because each liquid has particular properties including viscosity susceptible to varying ambient temperature. Of course, the number of colors is not limited to four, but may be two or five, if desired.

The coating device capable of controlling the speed of the coating roller 404 and that of the intermediate roller 405, as stated earlier, not only stabilizes image quality by reducing the variation of image density, but also allows the developing liquid to be coated in an amount optimum for the kind of a sheet used. More specifically, the operator inputs the kind of a sheet to use on the operation panel 420 or the control board 421 determines the kind of sheets stacked on a designated sheet cassette. In this case, rotation speeds of the motor 417 each implementing an optimum amount of developing liquid for a particular kind of sheet are stored in the memory 422. The control board 421 selects the optimum amount of developing liquid matching with the sheet to be used. The control board 421 then sends signals matching with the rotation speed selected to the controller 419 and driver 418, thereby controlling the rotation speed of the motor 417. Consequently, the developing liquid is deposited on the developing roller 402 in an amount optimum for the kind of the sheet.

Further, the operation panel 420 maybe provided with a function that allows the operator to select desired image density, in which case the developing liquid will be deposited on the developing roller 402 in an optimum amount matching with the desired image density. The color copier can therefore control the tone of a color image without varying image data itself.

Figure 14:
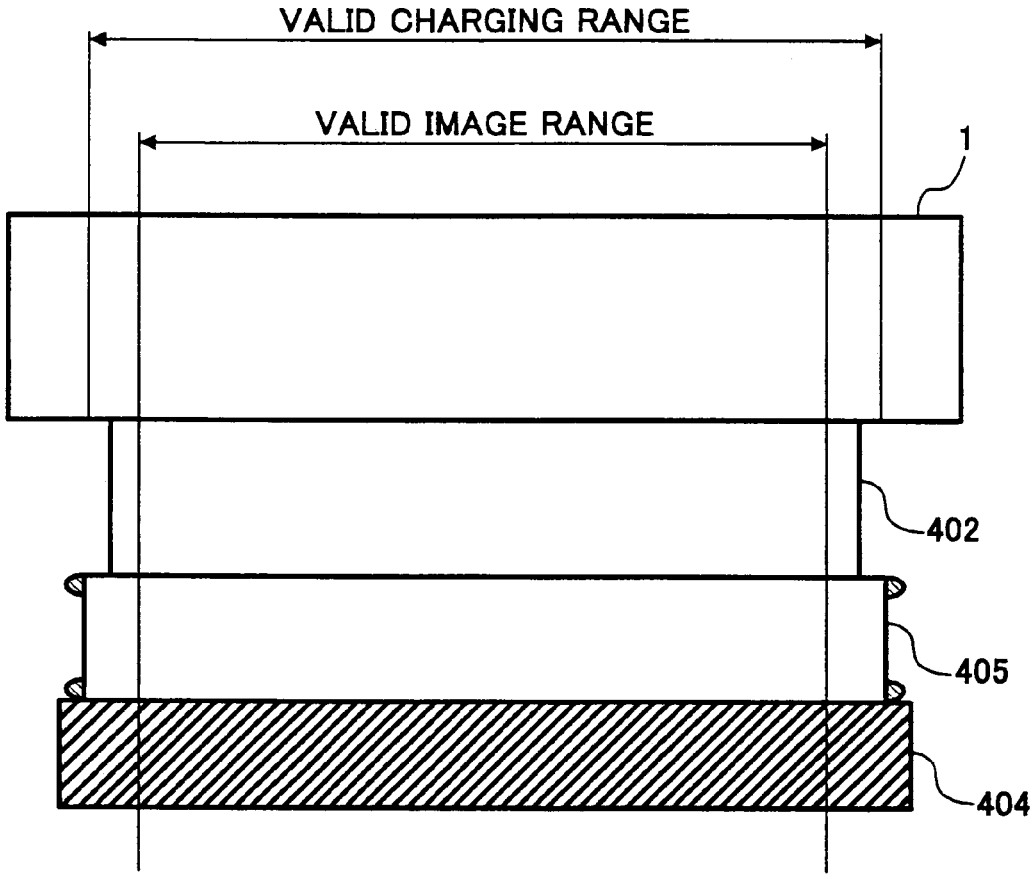
FIG. 14 shows a relation in width between the coating roller, the intermediate roller, the developing roller and a photoconductive drum.
Figure 15A:
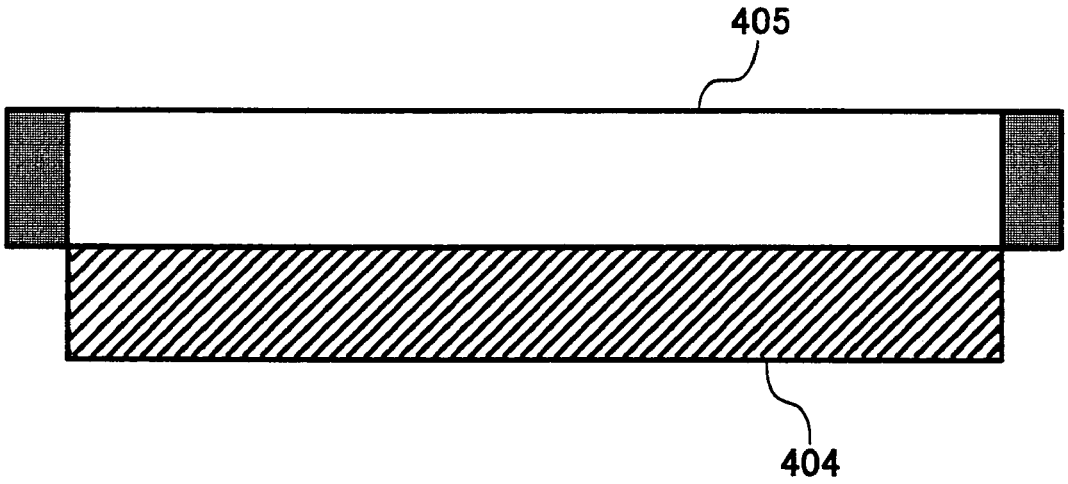
FIGS. 15A and 15B show a relation in width between the coating roller and the intermediate roller.
Figure 15B:
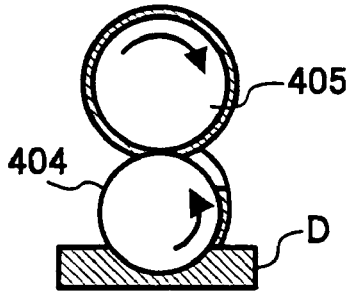

As shown in FIG. 14, in the illustrative embodiment, the coating roller 404 is provided with a greater width than the intermediate roller 405 in the axial direction, so that opposite end portions of the roller 404 do not contact the roller 405. As shown in FIGS. 15A and 15B, if such a relation between the coating roller 404 and the intermediate roller 405 is reversed, then excess part of the developing liquid squeezed out from between the rollers 404 and 405 deposits on the roller 405 and is transferred from the roller 405 to the developing roller 402. Consequently, this part of the developing liquid is transferred to a sheet via the drum 1 and belt 502, resulting in the degradation of image quality and wastefully consumption of the liquid.

In the configuration shown in FIG. 14, excess part of the developing liquid squeezed out from between the coating roller 404 and the intermediate roller 405 deposits on the roller 404. Stated another way, only the adequate amount of developing liquid moved away from the nip between the coating roller 404 and the intermediate roller 405 deposits on the intermediate roller 405, obviating the problems stated above. In addition, the intermediate roller 405 with the elastic layer 405*b* is prevented from being scratched by the end portions of the coating roller 404, which is a metallic roller.

Figure 16:
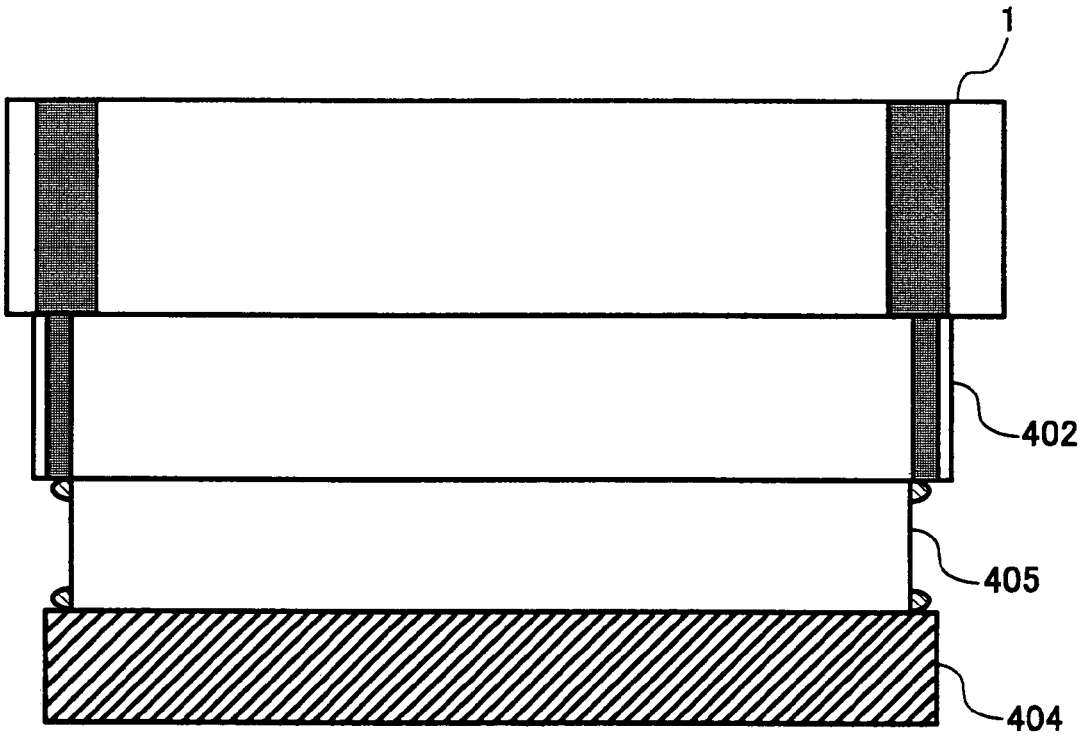
FIG. 16 shows a relation in width between the coating roller, the intermediate roller, the developing roller and the drum.

Assume that the developer roller 402 has a greater width than the intermediate roller 405, which forms the thin developer layer on the developing roller 402. Then, as shown in FIG. 16, the end portions of the intermediate roller 405 contact the developing roller 402. As a result, the developing liquid squeezed out of the nip between the roller 405 and the coating roller 404 and deposited on the end faces of the roller 405, although in a small amount, is transferred to the developing roller 402. The developing liquid so deposited on the developing roller 402 is extended in the axial direction at the nip between the roller 402 and the drum 1. This part of the developing liquid cannot be controlled by the electric field for development, but deposits on the drum 1, producing fog in the non-image portion and irregular density in the image portion. Although the developing roller 402 may be provided with a greater width than the drum 1 in order to prevent the end portions of the roller 402 from contacting the drum 1, this kind of scheme causes the developing roller 402 with the elastic layer 402*b* to contact the rigid drum 1 and scratch it.

It is difficult to uniformly charge the entire drum 1 in the axial direction, so that non-charged portions or portions with short charge usually exist at opposite end portions of the drum 1. Taking this into consideration, it is a common practice with this type of copier to determine a valid charging range and a valid image range. On the other hand, if the developing roller 402 contacts the portions with short charge, then the developing liquid is transferred from the developing roller 402 to the drum 1 because it cannot be controlled by the electric field for development. It follows that the width of the developing roller 402 must be smaller than the valid charging range of the drum 1, but greater the width of the valid image range.

For the reasons stated above, as shown in FIG. 14, the intermediate roller 405 is made longer than the developing roller 402. This prevents the developing liquid deposited on the end faces of the intermediate roller 405 from being transferred to the developing roller 402.

In the developing device of the type developing a latent image formed on the drum 1 with the thin developer layer deposited on the developing roller. 402, the developing liquid is, in many cases, partly left on the developing roller 402 after development. The solid content of such residual part of the developing liquid differs from the original solid content.

More specifically, in part of the developing liquid corresponding to the latent image or image portion, the solid is deposited on the drum 1 while the carrier is left on the developing roller 402 alone. On the other hand, in part of the developing liquid corresponding to the non-image portion, the carrier is partly deposited on the drum 1 while substantially the entire solid, i.e., the dense developing liquid is left on the developing roller 402. If the developing liquid is again coated on the developing roller 402 for the next development over the residual developing liquid, then a density difference occurs in the thin developer layer coated on the developing roller 402, resulting in the ghost of the previous image. It is therefore necessary to remove the developing liquid used for the previous development from the developing roller 402 before again coating the developing liquid on the roller 402.

It is a common practice with the developing device to remove the residual developing liquid from the developing roller 402 by use of a blade held in contact with the surface of the roller 402. The blade is formed of rubber or implemented as a laminate of rubber and metal.

In the illustrative embodiment, the surface of the intermediate roller 405 contacts the surface of the developing roller 402 in such a manner as to move in the opposite direction to the developing roller 402, as seen at the position where the former contacts the latter, as stated earlier. The intermediate roller 405 can therefore clean the surface of the developing roller 402 and makes it needless to use an exclusive cleaning member. The exclusive cleaning member might damage the surface of the developing roller 402 and would increase the load on the drive of the roller 402.

On the other hand, if part of the developing liquid left on the intermediate roller 405 after the transfer of the liquid to the developing roller 402 is not removed, then the residual developing liquid is again fed to the developing roller 402 via the nip between the rollers 405 and 402, resulting in the ghost stated above. In the illustrative embodiment, as shown in FIG. 4, the cleaning member 411 held in contact with the intermediate roller 405 removes the residual developing liquid from the roller 405.

More specifically, the cleaning member 411 is implemented as a rubber blade. The developing liquid removed by the cleaning member 411 is collected in the temporary storage 412 without being mixed with the adjusted developing liquid present in the reservoir 401. The collected developing liquid is then conveyed by the screw 413 to the density adjusting section, adjusted in toner content, and then returned to the reservoir 401. In this manner, the cleaning member 411 can remove the residual developing liquid from the developing roller 402 via the intermediate roller 405, thereby obviating the ghost.

Figure 17A:
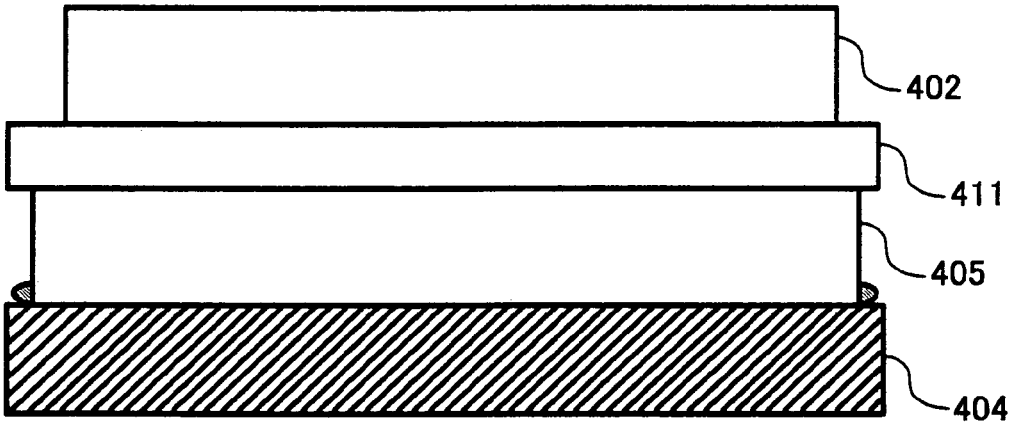
FIGS. 17A and 17B show a relation in width between the coating roller, the intermediate roller, the developing roller and a cleaning blade.
Figure 17B:
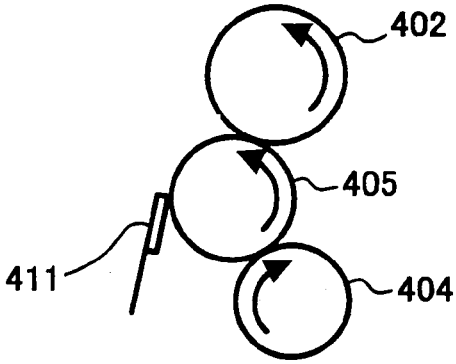

As shown in FIGS. 17A and 17B, the cleaning member 411 should preferably be greater in width than the developing roller 402 in the axial direction in order to remove all the developing liquid left on the developing roller 402 after development. Should the developing liquid left on the developing roller 402 and not adjusted in toner content be again used for development, it would bring about various image detects including an irregular density distribution.

Further, if the cleaning member or blade 411 is smaller in width than the intermediate roller 405 in the axial direction, then stress concentrates on the surface portion of the intermediate roller 405 contacting the edge of the cleaning member 411 and is likely to damage the above surface portion. In this respect, the cleaning member 411 should preferably be greater in width than the intermediate roller 405, see FIG. 17A. By so limiting the width of the cleaning member 411, it is possible to prevent the residual developing liquid left on the developing roller 402 from being again used without adjustment.

The developing roller 404 formed with the cells 404*a* in a uniform pattern over its entire circumference may be replaced with a plain roller not formed with the cells 404*a*, i.e., having a smooth surface. When a plain roller is replaced with the developing roller 404, the amount of the developing liquid to pass through the nip between the coating roller 404 and the intermediate roller 405 is determined by pressure to act between the rollers 404 and 405, geometric configurations of the rollers 404 and 405, longitudinal elasticity constants of the rollers 404 and 405, viscosity of the developing liquid, and rotation speeds of the rollers 404 and 405. The distribution ratio of the developing liquid to the rollers 404 and 405 is determined by the speed ratio between the rollers 404 and 405.

However, it is difficult to uniform the pressure acting between the plain roller and the intermediate roller 405 in the axial direction because of limited mechanical, dimensional accuracy and uniformity of material constants. The irregular pressure distribution between the plain roller and the intermediate roller 405 would cause the amount of the developing liquid transferred from the plain roller to the intermediate roller 405 to vary.

By contrast, the coating roller 404 of the illustrative embodiment can accurately measure the developing liquid to be applied to the coating roller 404 on the basis of the cell volume of the cells 404*a*, as stated earlier. In the illustrative embodiment, the cells 404*a* that need high dimensional accuracy are formed on the surface of the coating roller 404 by transfer. Transfer is advantageous over machining because it can substantially faithfully reproduce the shape of a die and can cause a surface to solidify by plastic deformation. However, transfer is not feasible for materials having hardness of 200 HV or above. A surface needing hardness is plated with hard chromium or otherwise treated.

Figure 18:
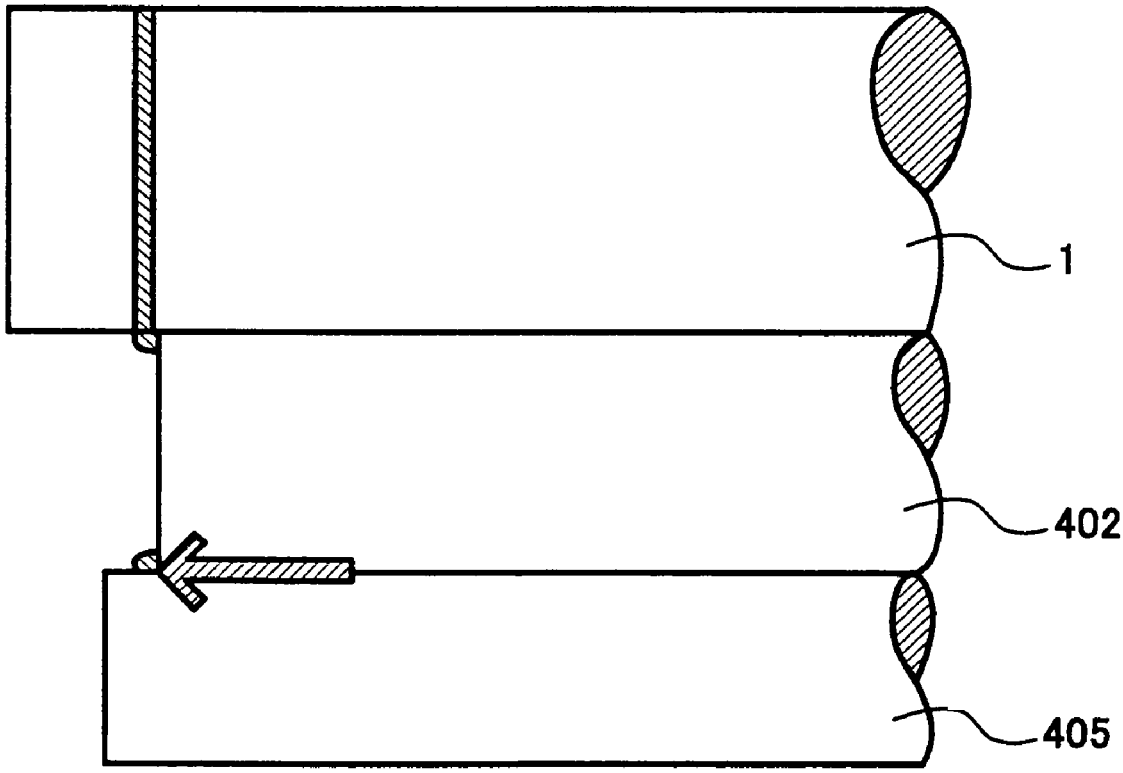
FIG. 18 shows a relation in width between the intermediate roller, the developing roller and the drum.

When the cells 404*a* are formed in the entire surface of the coating roller 404, the developing liquid is transferred from the roller 404 to the entire surface of the intermediate roller 405. As shown in FIG. 17A, the developing roller 402 is smaller in width than the intermediate roller 405 in the axial direction. Consequently, as shown in FIG. 18, when the developing liquid is transferred from the intermediate roller 405 to the developing roller 402, excess part of the developing liquid, although small in amount, squeezed out from the nip between the rollers 402 and 405 in the axial direction deposits on the end of the roller 402 and is transferred from the roller 402 to the drum 1. This part of the developing liquid is further transferred from the drum 1 to the belt 502 and therefore to a sheet while increasing the load on the cleaning device 6 assigned to the drum 1.

Figure 19:
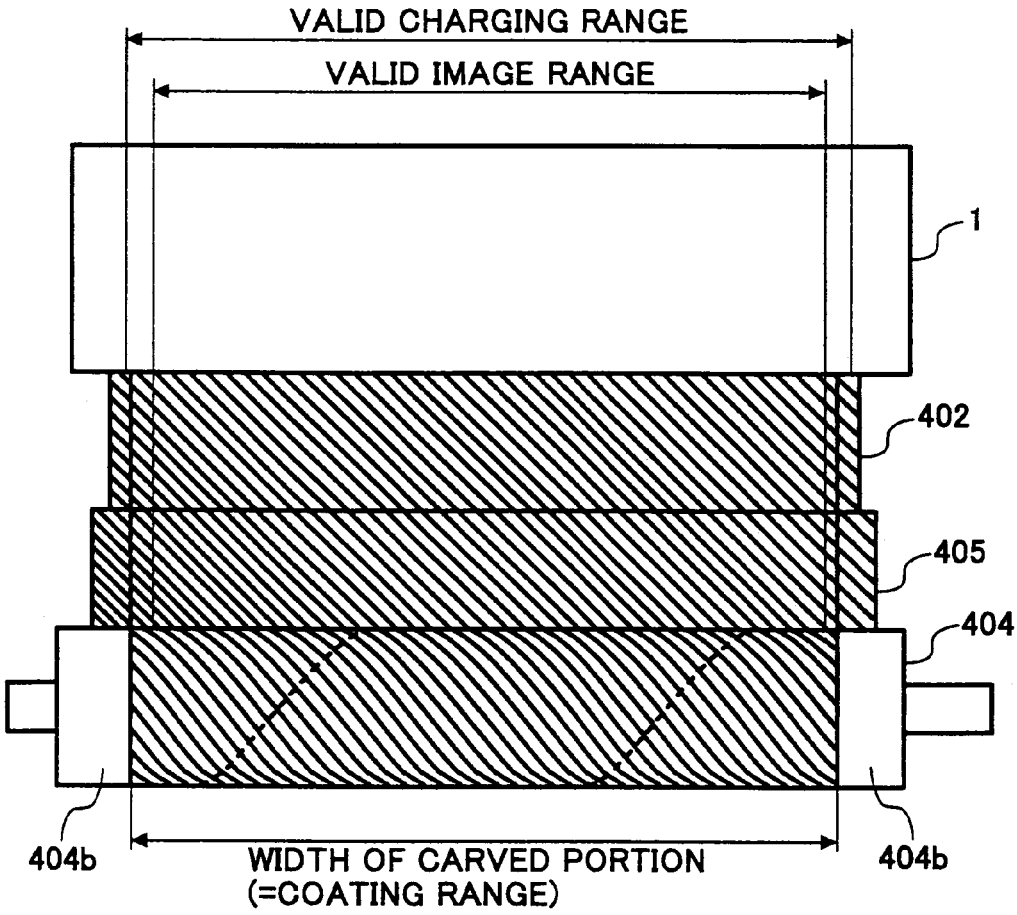
FIG. 19 shows a relation in width between the intermediate roller, developing roller and drum and the cells of the coating roller.

To solve the above problem, as shown in FIG. 19, the coating roller 404 is not formed with the cells 404*a* in its opposite end portions 404*b*. In this configuration, hardly any developing liquid is transferred to the portions of the intermediate roller 405 facing the end portions or non-carved portions 404*b* of the coating roller 404. Stated another way, the developing liquid is transferred only to the portion of the intermediate roller 405 facing the intermediate portion of the coating roller 404 formed with the cells 404*a*.

As shown in FIG. 19, the intermediate roller 405 is provided with a greater width than the portion of the coating roller 404 formed with the cells 404*a* (coating range) in the axial direction, so that the developing liquid does not deposit on the opposite end portions of the intermediate roller 405.

Also, the developing roller 402 is provided with a greater width than the above coating range of the coating roller 404 in the axial direction such that opposite end portions of the developing roller 402 contact the end portions of the intermediate roller 405. This successfully obviates the deposition of the developing liquid on the end of the developing roller 402. At this instant, it is necessary to make the coating range of the coating roller 404 wider than the valid image range of the drum 1 and to make the valid charging range of the drum 1 slightly wider than the coating range of the coating roller 404. If the valid charging range is excessively wide, then the surface portions of the developing roller 402 not coated with the developing liquid contact the drum 1 and render the electric field formed in the developing zone A unstable.

Second Embodiment

Figure 20:
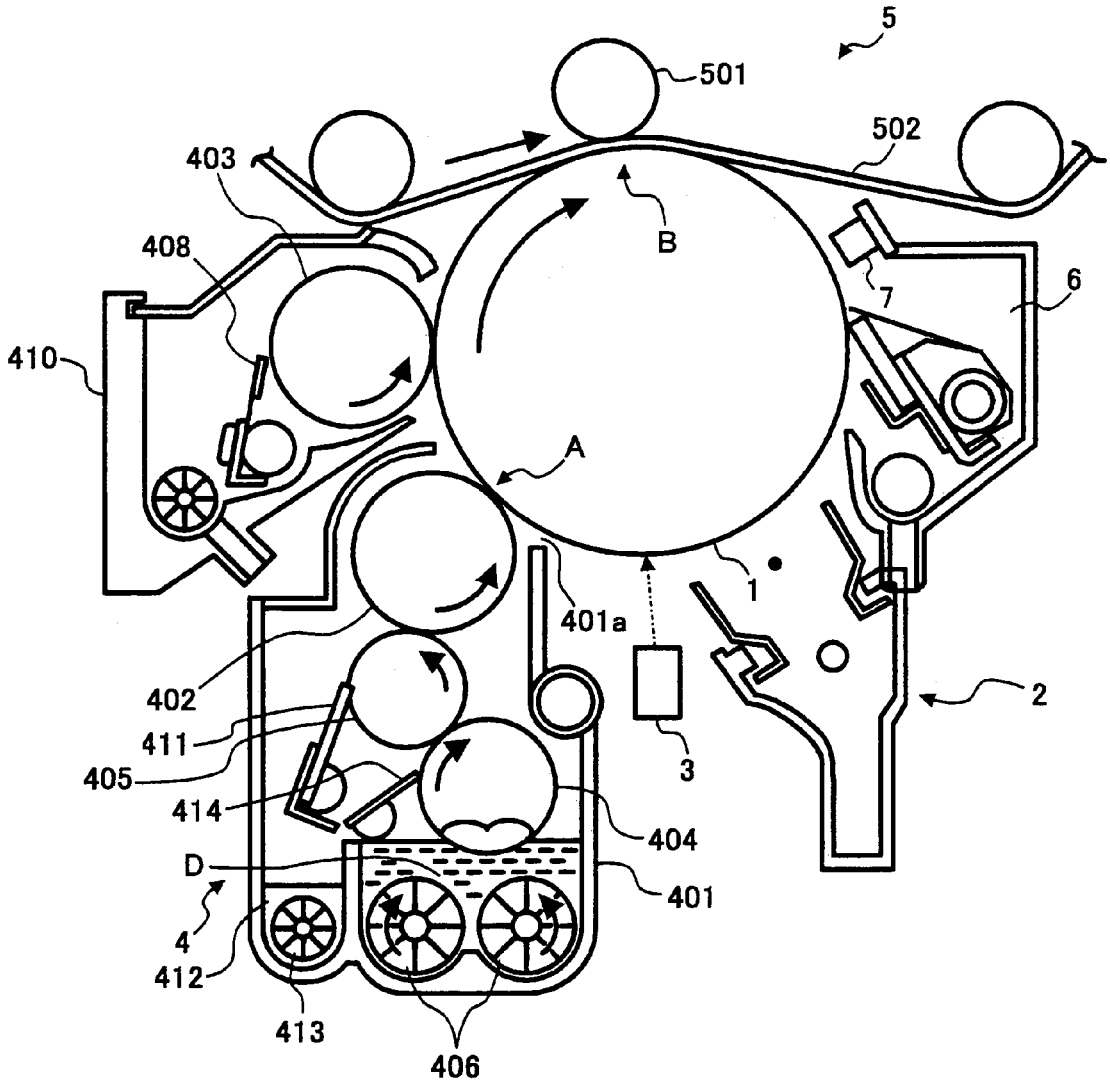
FIG. 20 is a view showing major part of a second embodiment of the image forming apparatus in accordance with the present invention.

Referring to FIG. 20, an alternative embodiment of the present invention also implemented as an electrophotographic copier will be described hereinafter. As shown, as for basic construction, the illustrative embodiment is generally identical with the previous embodiment. The following description will concentrate on features unique to the illustrative embodiment in order to avoid redundancy.

Figures 21, 22:
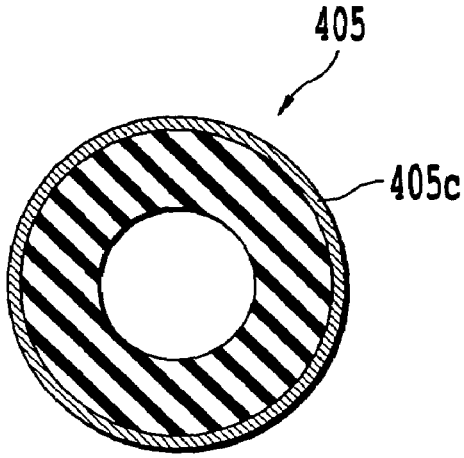
FIG. 21 is a section showing an intermediate roller included in a coating device that forms part of a developing device included in the second embodiment.
FIG. 22 shows a relating between the surface resistance of the intermediate roller of FIG. 21 and the coating condition.

The surface of the intermediate roller 405 and that of the developing roller 402 move in opposite directions to each other at the position where they contact each other, as stated previously. Therefore, if the elastic layer of the intermediate roller 405 having a large coefficient of friction is exposed to the outside, then extremely high frictional resistance is generated at the above contact position. Such frictional resistance not only increases the load on the driveline assigned to the intermediate roller 405 and developing roller 402, but also noticeably reduces the life of the rollers 405 and 402. In light of this, a smooth layer with a small coefficient of friction covers the surface of the intermediate roller 405. Again, the smooth layer may be implemented by PTFE, PFA, PVDF, PVF or similar fluorocarbon resin coated on the intermediate roller 405 or a tube formed of fluorocarbon resin and covering the roller. In the illustrative embodiment, as shown in FIG. 21, use is made of a 50 $\mu$m thick, PFA tube 405C fitted on the intermediate roller 405. The developing roller 402 is also covered with a 50 $\mu$m thick, conductive PFA tube.

When use was made of a PFA tube whose carbon content was reduced for enhancing the mechanical strength of the surface of the intermediate roller 405, the developing liquid was scattered away from the coating surface of the roller 405. It was experimentally found that when the surface layer of the intermediate roller 405 had high resistance, frictional charge occurred between the developing roller 402 and the cleaning blade 411 and caused the developing liquid to be scattered around. FIG. 22 shows the results of a series of experiments conducted by varying the resistance of the surface layer. As shown, so long as the surface resistance of the intermediate roller 405 is $10^{13}$ $\Omega/cm^2$ or below, the developing liquid is prevented from being scattered around.

More specifically, as shown in FIG. 22, sample Nos. 1 through 6 of the intermediate roller 405 respectively having surface resistances R of R>$10^{13}$ $\Omega/cm^2$, $10^{12}$ $\Omega/cm^2$, $10^{11}$ $\Omega/cm^2$, $10^{10}$ $\Omega/cm^2$ and $10^6$ $\Omega/cm^2$ were prepared and estimated as to durability. Only the sample No. 6 whose surface resistance R was higher than $10^{13}$ $\Omega/cm^2$ caused the developing liquid to be scattered away from the intermediate roller 405 due to the charge. This is why the surface resistance of the intermediate roller 405 should preferably be $10^{13}$ $\Omega/cm^2$ or below. While the lower limit of the surface resistance is not definite as to function, it is about $10^5$ $\Omega/cm^2$ for production reasons.

Referring again to FIG. 20, the developing roller 402 is applied with the bias for forming the electric field in the developing zone between the roller 402 and the drum 1. The intermediate roller 405 is held in contact with the developing roller 402 and coating roller 404, which is a metallic roller. Therefore, the voltage applied to the developing roller 402 leaks and cannot form the electric field unless the surface layer of the intermediate roller 405 is electrically insulative. It follows that the coating roller 404 and cleaning blade 414 must be electrically insulated from the body that supports them. Further, if the coating roller 404 and cleaning blade 414 are electrically floating, then they are charged and effect the electric field. To solve this problem, in the event of image formation, a voltage is applied to the intermediate roller 405 such that the surface of the roller 405 is of the same potential as the surface of the developing roller 402, thereby insuring a stable image. To set the potential of the intermediate roller 405, a terminal may be held in contact with the shaft of the intermediate roller 405 if the inner layer of the roller 405 is conductive. If the inner layer is insulative, then the voltage may be applied to the intermediate roller 405 via the coating roller 404.

The developing roller or developer carrier 402 is pressed against the drum or image carrier 1 with its elastic layer being deformed, so that the nip for development is formed between the roller 402 and the drum 1. At this instant, a sufficient nip is insured by, e.g., making the hardness of the elastic layer low. For this purpose, in the illustrative embodiment, the elastic layer of the developing roller 402 is formed of conductive urethane resin having hardness of 25° in terms of JIS-A scale. Generally, to provide the elastic layer with low hardness, resin containing, e.g., oil is used. This kind of scheme, however, causes the shape of the elastic layer to vary when the elastic layer left in the deformed condition over a long period of time. If the deformation of the elastic layer is not small, then the elastic layer can restore its original shape after the developing roller 402 has been rotated for a while. However, the elastic layer undergoes permanent set if its deformation is great and if the deformed condition lasts over a long period of time in a hot environment. The so deformed developing roller 402 causes the amount of the developing roller to deposit thereon to vary in accordance with the deformation, critically lowering image quality. It is wasteful to replace the deformed developing roller 402 before its life ends.

Figure 23:
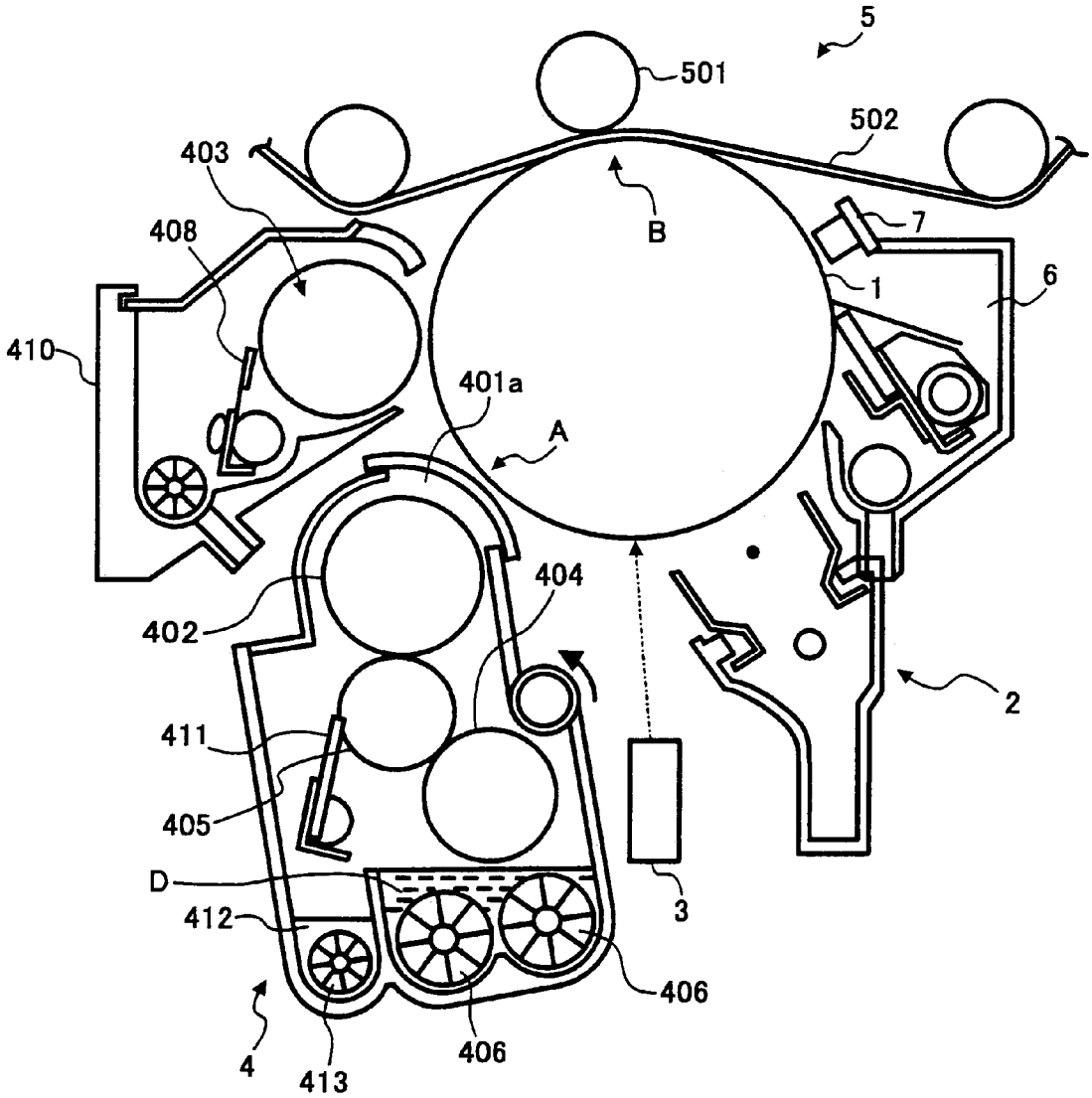
FIG. 23 shows a developing roller included in the developing device in a position released from a photoconductive drum.

In light of the above, as shown in FIG. 23, the illustrative embodiment includes a moving mechanism for selectively moving the developing roller 402 and drum 1 into or out of contact with each other. When image formation is not under way, the moving mechanism releases the developing roller 402 from the drum 1 and thereby prevents the roller 402, which is in a halt then, from remaining in pressing contact with the drum 1 over a long period of time.

Figure 24:
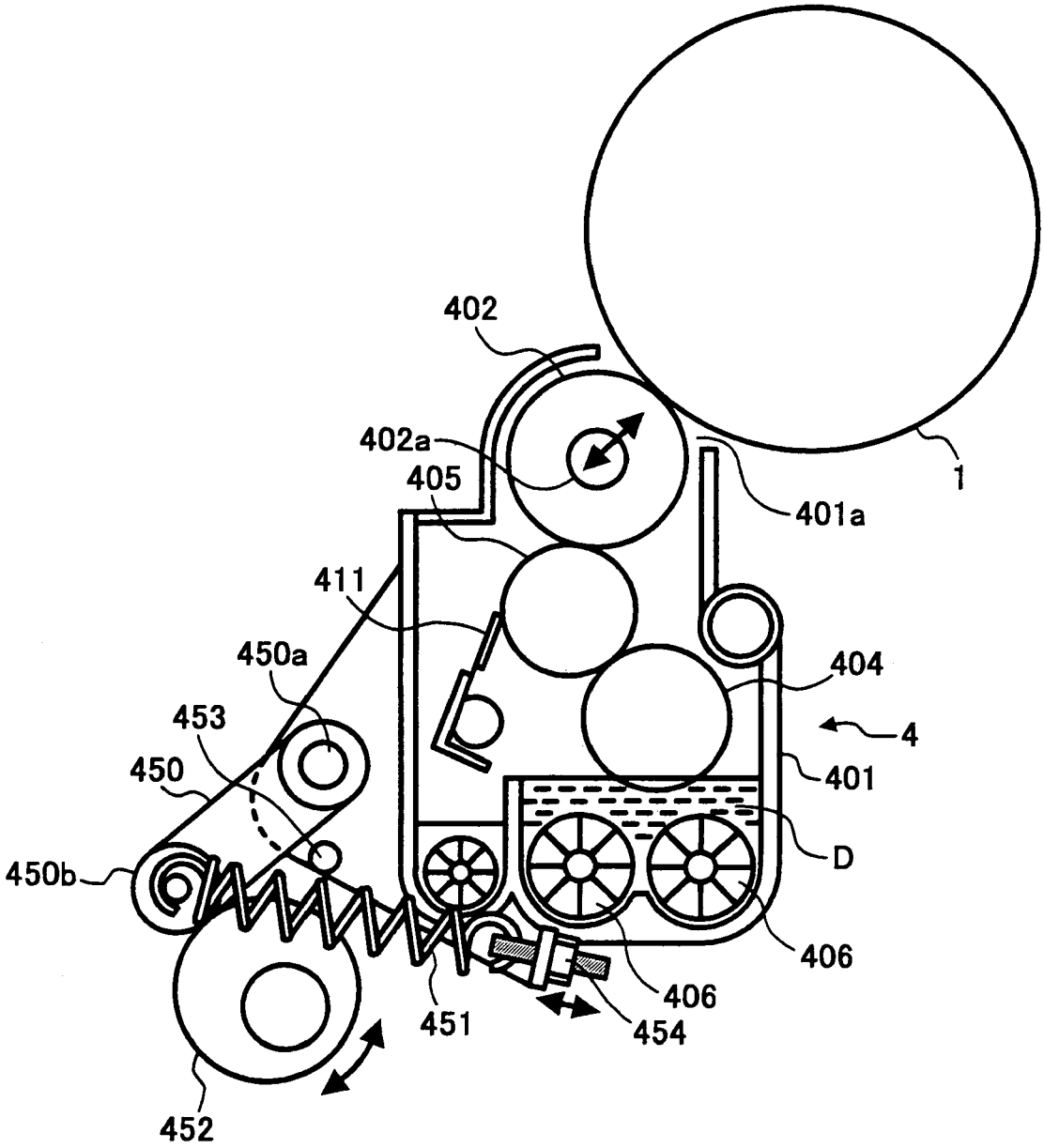
FIG. 24 shows a moving mechanism for selectively moving the developing roller into or out of contact with the drum.
Figure 25:
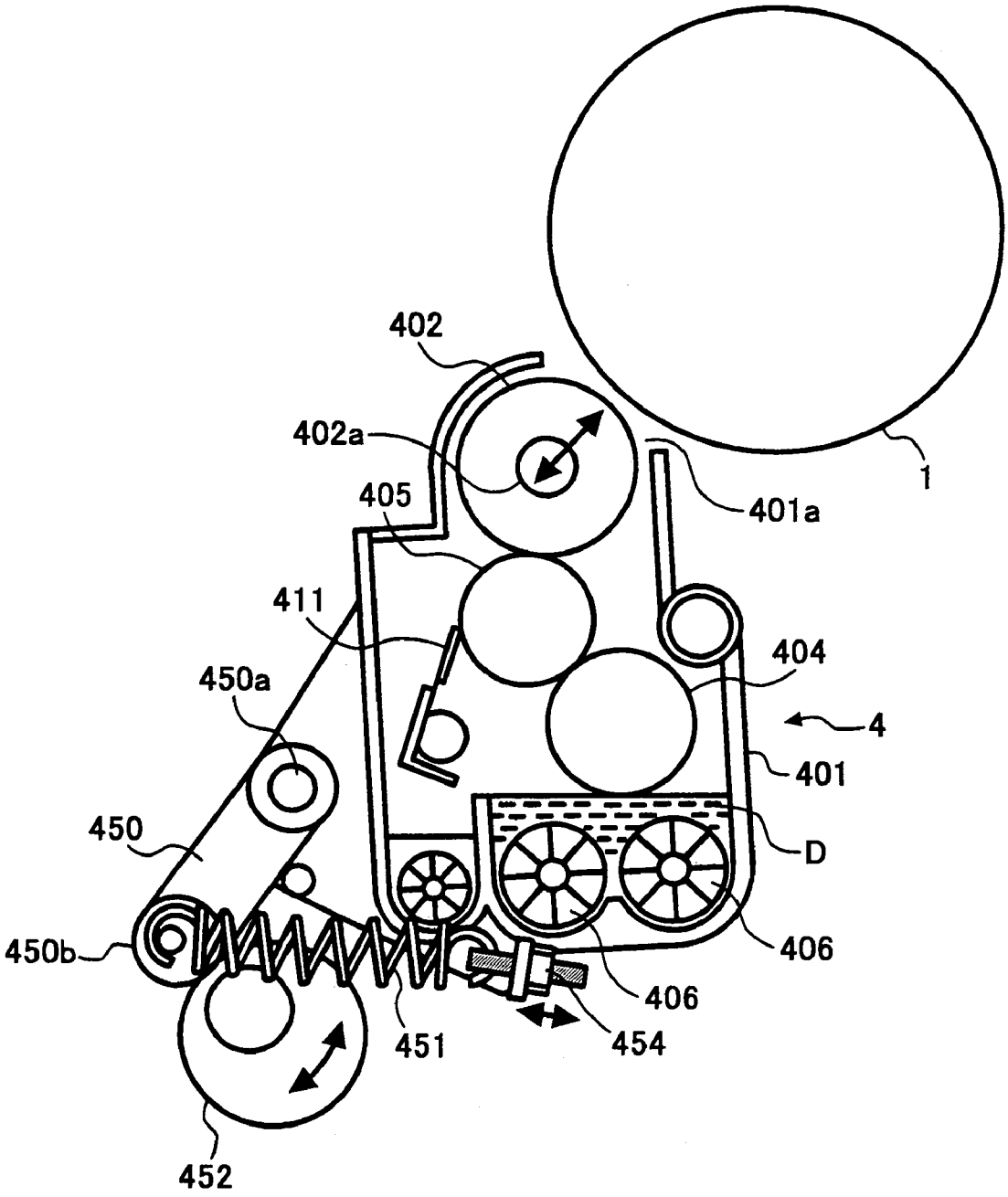
FIG. 25 shows the developing roller released from the drum by the moving means.

FIGS. 24 and 25 show a specific configuration of the moving means mentioned above. As shown, the reservoir 401, supporting the developing roller 402, is angularly movable about a fulcrum 450*a* provided on a press arm 450. A spring or biasing means 451 is anchored to the press arm 450 at one end and constantly biases the shaft 402*a* of the developing roller 402 or a member supporting the shaft 402*a* such that the roller 402 tends to contact the drum 1. A cam follower 450*b* is mounted on the free end of the press arm 450 and held in contact with the edge of an eccentric cam 452 by the force of the spring 451. The cam 452 causes the press arm 450 to angularly move about the fulcrum 450*a* when driven to rotate. The movable range of the press arm 450 is delimited by the eccentricity of the cam 452 and a stop 453. The biasing force of the spring 451 is adjustable via a screw 454.

While the condition in which the developing roller 1 is pressed against the drum 1 is determined by the eccentricity of the cam 452, as stated above, the condition may alternatively be determined by the biasing force of the spring 451. The problem with the eccentricity scheme is that any different in the eccentricity of the cam 452 translates into a noticeable change in the condition of contact of the developing roller 402 with the drum 1, resulting in the need for extremely accurate control. In light of this, the moving mechanism may press the developing roller 402 against the drum 1 with the biasing force of the spring 451 and release the former from the latter with the eccentricity of the cam 452, so that the cam 452 with relatively low accuracy can implement a preselected pressing condition.

In FIGS. 24 and 25, the moving mechanism causes the developing roller 402 and coating device to bodily move about the fulcrum 450*a*. Alternatively, the moving mechanism may be modified to move the coating device horizontally or move only the developing roller 402.

The coating device with the developing roller 402 is arranged in the reservoir 401, which is a substantially hermetically sealed container except for the portion where the roller 402 contacts the drum 1. Therefore, a minimum of impurities is allowed into the reservoir 401; otherwise, impurities would be introduced in the developing liquid and would make coating of the liquid defective, produce stripes, and damage or wear the surfaces of the developing roller 402 and intermediate roller 405 by blocking their nip.

Figure 26:
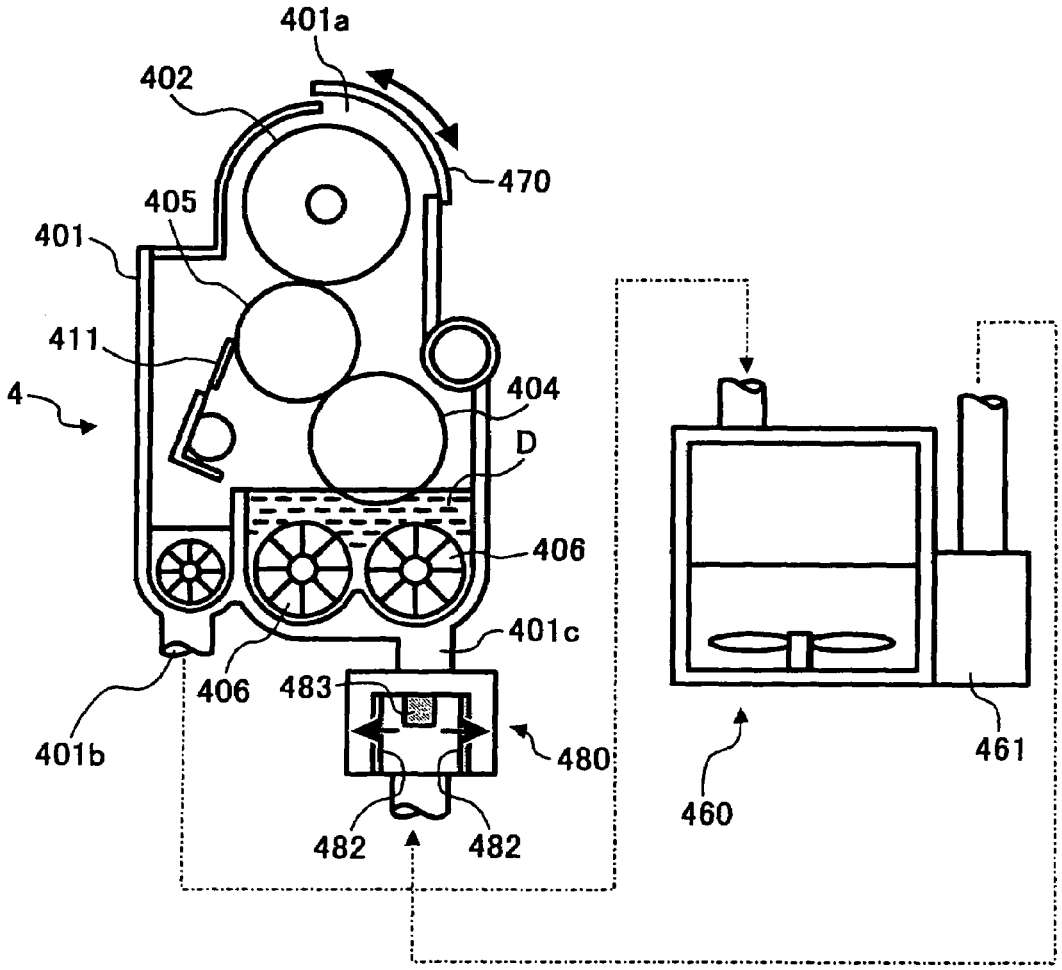
FIG. 26 demonstrates the flow of a developing liquid in the coating device.

FIG. 26 shows a specific configuration of the hermetically sealed reservoir 401. As shown, the developing roller 402, intermediate roller 405, coating roller 404 and screw 406 are accommodated in the reservoir 401. The reservoir 401 is formed with an inlet port 401*c* for feeding the developing liquid D to the reservoir 401 and an outlet port 401*b* for discharging the developing liquid removed from the rollers 402 through 405.

A pump 461 delivers the developing liquid with the adjusted toner content from a density adjusting device 460 to the reservoir 401 via the inlet port 401*c*. The screw 406 conveys the incoming developing liquid D while agitating it such that the liquid D is distributed mainly in the lengthwise direction of the reservoir 401.

The reservoir 401 is divided into an inlet chamber and an outlet chamber. The coating roller 404 is immersed in the developing liquid stored in the inlet chamber. The developing liquid deposited on the coating roller 404 is metered by the coating roller 404 and intermediate roller 405 and then coated on the developing roller 402 by the intermediate roller 405 in a thin layer. The developing liquid left on the developing roller 402 after development is removed by the intermediate roller 405 and then collected by the cleaning blade 411 contacting the roller 405. The developing liquid collected by the cleaning blade 411 should not be directly used for the next development because its toner content has varied. The developing liquid is therefore once stored in the outlet chamber, delivered to the density adjusting section 460 via the outlet port 401*b*, and then returned to the reservoir 401 via the inlet port 401*c*. Part of the developing liquid overflowed the inlet chamber is introduced in the outlet chamber in the same manner as in the previous embodiment, maintaining the amount of the developing liquid in the reservoir 401 constant.

The hermetically sealed reservoir 401 must be formed with an opening 401*a* for allowing the developing roller 402 to contact the drum 1. Therefore, in the coating device constructed to be angularly movable together with the developing roller 402, the opening 401*a* is widely opened when the developing roller 402 is released from the drum 1. In this condition, impurities are likely to enter the coating device via the opening 401*a*. To solve this problem, a shutter 470 should preferably selectively open or close the opening 401*a*. When the developing roller 402 is spaced from the drum 1, e.g., when image formation is not under way, the shutter 470 closes the opening 401*a* to thereby prevent impurities from entering via the opening 401*a*.

Figure 27:
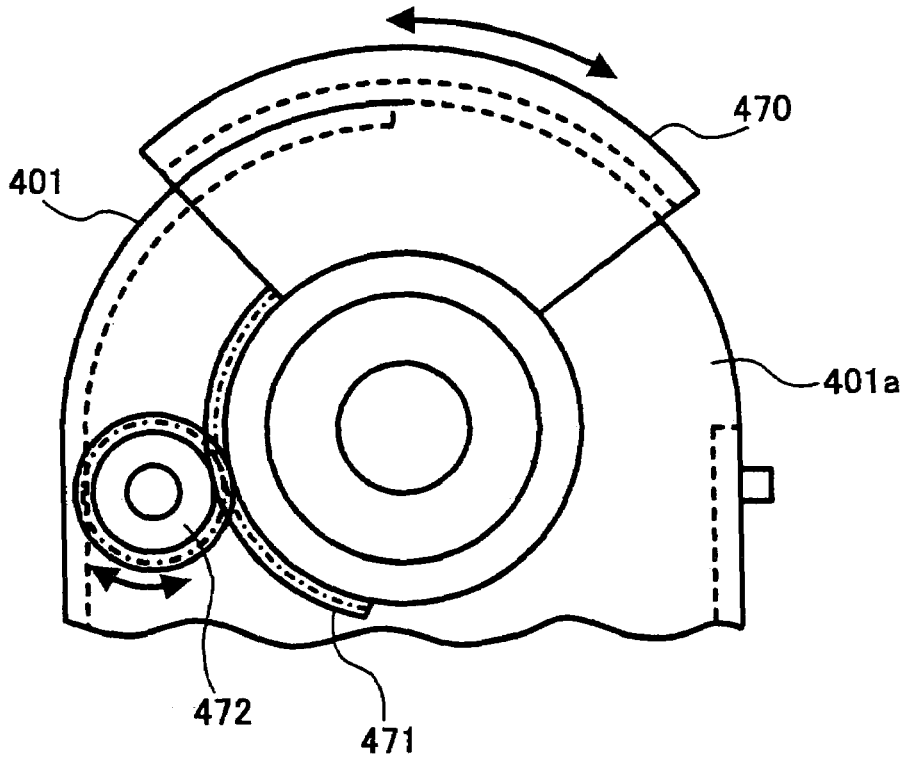
FIG. 27 is a fragmentary view showing a mechanism for driving a shutter included in the coating device.

FIG. 27 shows a specific configuration of a mechanism for opening and closing the shutter 470. As shown, the shutter 470 is mounted on the reservoir 401 in such a manner as to be pivotable to open or close the opening 401*a*. The pivotal portion of the shutter 470 is implemented as a gear 471 held in mesh with a drive gear 472, which is interlocked to the cam 452 of the moving mechanism. In this configuration, when the developing roller 402 moves into or out of contact with the drum 1 in accordance with the rotation of the cam 452, the drive gear 472 causes the shutter 470 to open or close, respectively, the opening 401*a* of the reservoir 401 via the gear 471. If desired, the shutter 470 may be caused to open and close the opening 401*a* by a spring or a rotatable cam.

Although the shutter 470 prevents impurities from entering the reservoir 401 via the opening 401*a*, it is likely that impurities are contained in the developing liquid newly fed to the reservoir 401 via the inlet port 401*c*. To cope with such impurities, as shown in FIG. 26, an impurity removing device or means 480 should preferably be positioned upstream of the inlet port 401*c*. The impurity removing device 480 includes a filter 482 for filtering out paper dust and other nonmetallic impurities and a magnet 483. The filter 482 is configured in parallel to the stream of the developing liquid because its area and therefore life would be reduced if positioned perpendicularly to the flow. Also, the filter 482 should preferably be disposed in a conduit providing communication between the density adjusting device 460 and the reservoir 401. In the illustrative embodiment, an arrangement is made such that the developing liquid efficiently flows through the filter 462 because of the pressure of the pump 461. In addition, the filter 482 so configured and arranged is easy to replace or clean periodically.

Figure 28:
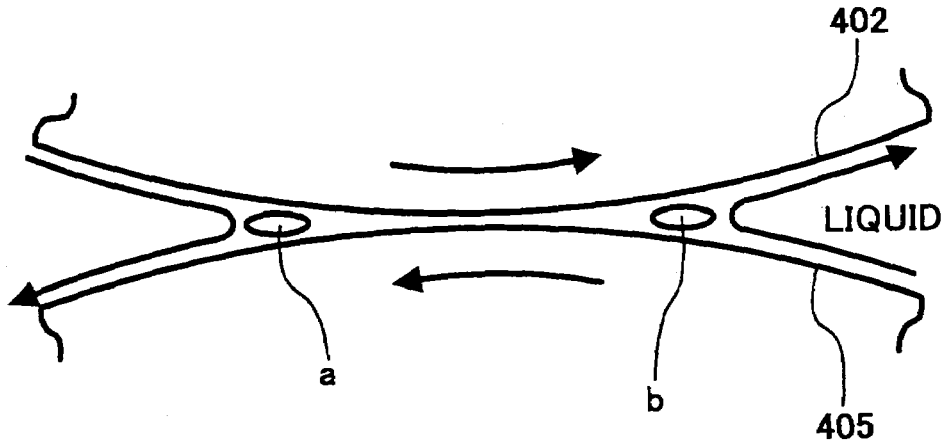
FIG. 28 shows a condition wherein the developing liquid exists at a nip between the intermediate roller and the developing roller.

The surface of the developing roller 402 moves in the opposite direction to the surface of the intermediate roller 405, as stated earlier. In this condition, as shown in FIG. 28, the developing liquid is subjected to an intense shearing force at and around the inlet and outlet of the nip between the developing roller 402 and the intermediate roller 405, so that unstable zones a and b appear in the thin developer layer. Should impurities enter the unstable zone a or b, they cannot escape from it and form continuous stripes on the coated surface of the developing roller 402. Such impurities entered the unstable zone a, or b can be effectively removed if the developing roller 402 and intermediate roller 405 are released from each other. For this purpose, a moving mechanism should be provided that selectively moves the developing roller 402 and intermediate roller into or out of contact with each other 405.

Figure 29:
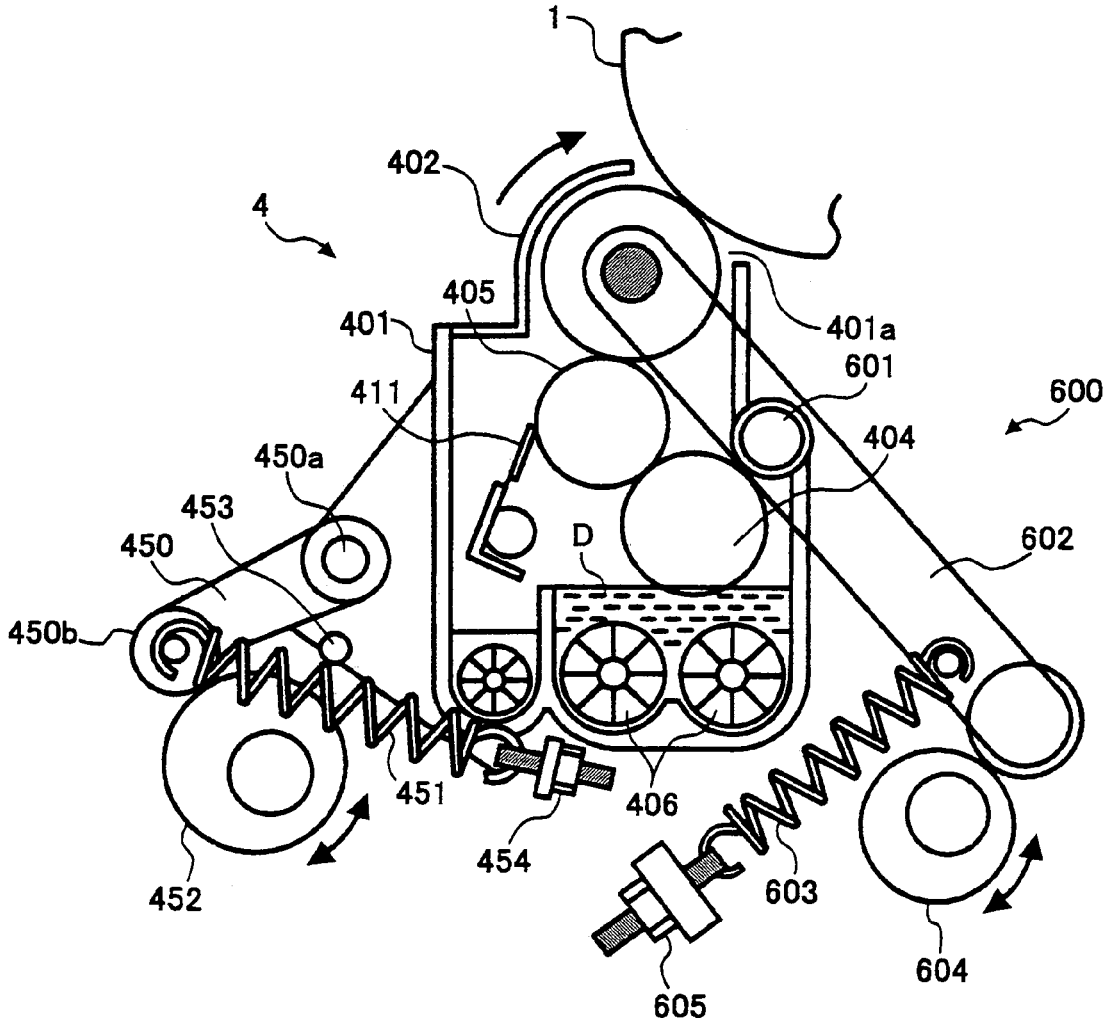
FIG. 29 shows another moving mechanism for selectively moving the developing roller into or out of contact with the drum.
Figure 30:
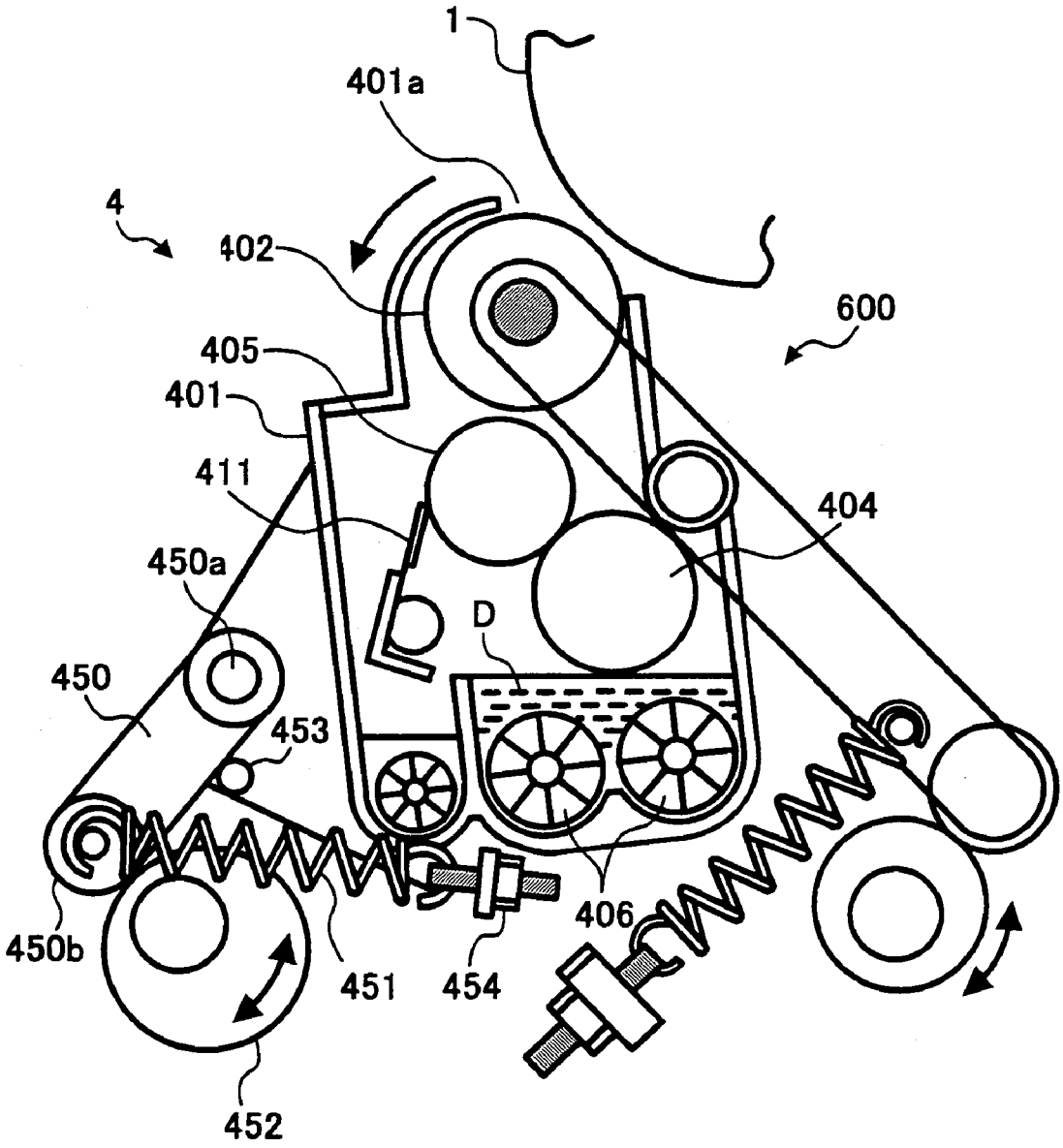
FIG. 30 shows the developing roller released from the drum by the moving mechanism of FIG. 29.

FIGS. 29 and 30 show a specific configuration of the moving mechanism that moves only the developing roller 402 into and out of contact with the drum 1. As shown, the moving mechanism, generally 600, includes a press arm 602 angularly movable about a shaft 601. A spring or biasing means 603 constantly biases the press arm 602 such that the developing roller 402 tends to move toward the drum 1. A cam 604 is pressed against a cam follower mounted on the press arm 602. When the cam 604 is rotated, it causes the press arm 602 to angularly move about the shaft 601. The biasing force of the spring 603 is adjustable via a screw 605.

As stated above, the moving mechanism 600 for moving only the developing roller 402 is provided independently of the moving mechanism assigned to the entire coating device and can move the roller 402 into or out of contact with the intermediate roller 405 only if the strokes of the two moving means are slightly different from each other. By releasing the developing roller 402 from the intermediate roller 405 periodically, e.g., before the start of image formation or when every 1,000 copies are continuously output, it is possible to obviate the degradation of image quality ascribable to impurities accumulated at the nip between the rollers 405 and 402.

However, the problem with the moving mechanism 600 is that it occupies an additional space and makes the developing device 4 bulky while making the operation sequence thereof sophisticated. It is therefore preferable to interlock the moving mechanisms assigned to the entire coating device and developing roller 402, respectively.

Figure 31:
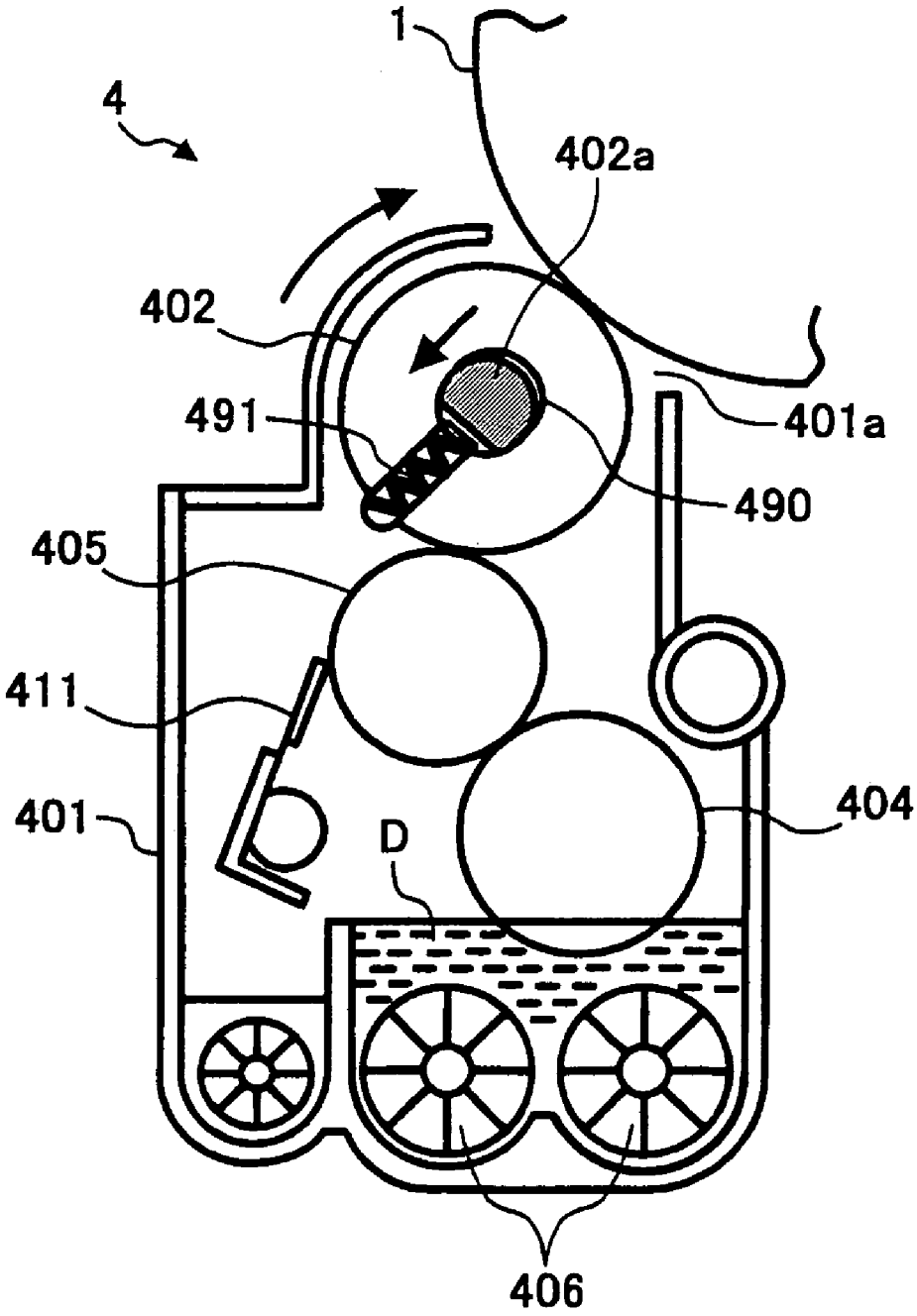
FIG. 31 shows still another moving mechanism for selectively moving the developing roller into or out of contact with the drum.
Figure 32:
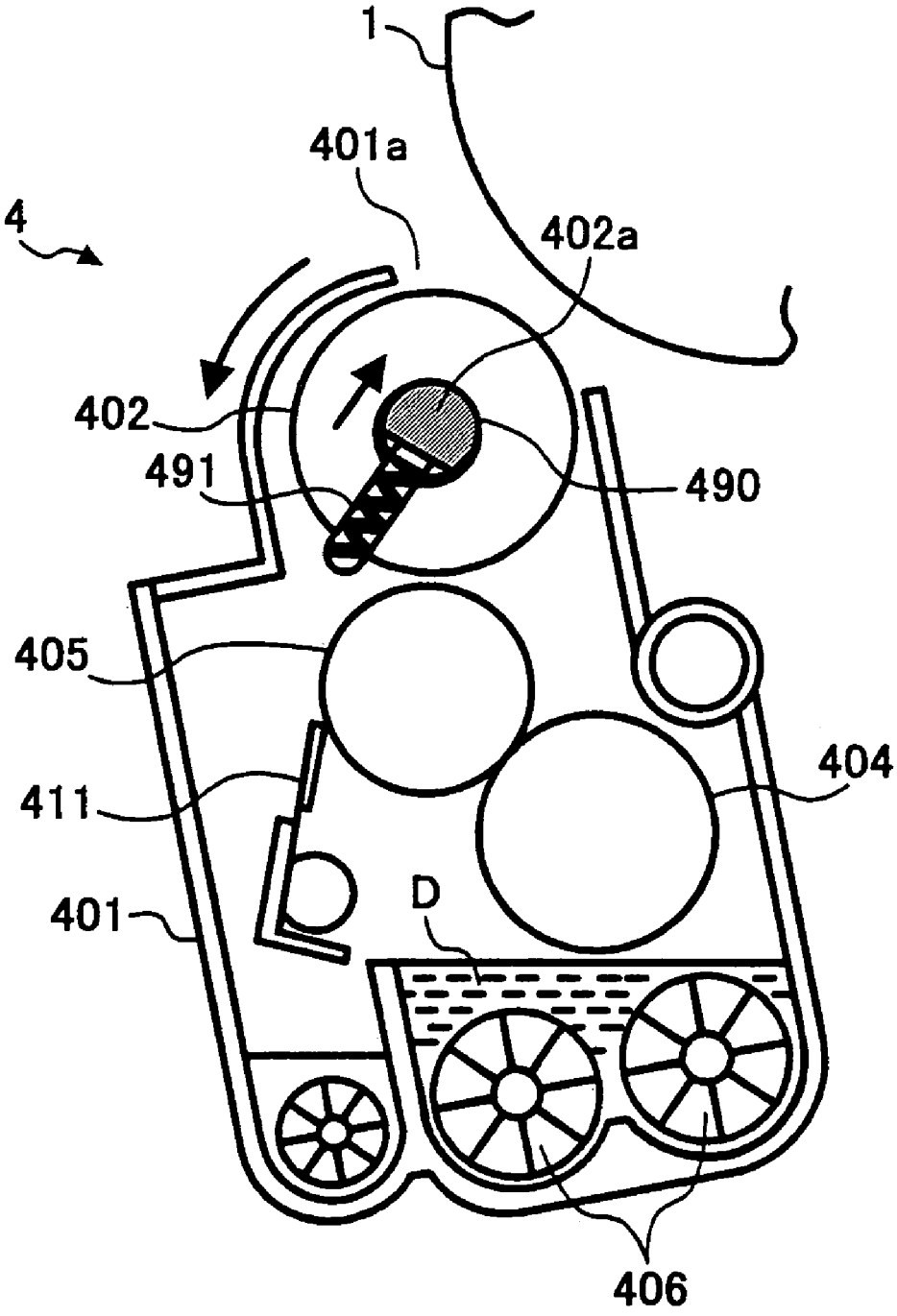
FIG. 32 shows the developing roller released from the drum by the moving mechanism of FIG. 31.

FIGS. 31 and 32 show a specific configuration of the developing device 4 in which the two moving mechanisms respectively assigned to the coating device and developing roller 402 are constructed substantially integrally with each other. As shown, a support member supporting the shaft 402*a* of the developing roller 402 includes a bearing portion formed with a slot 490 elongate in the direction normal to the drum 1. A spring or biasing means 491 is received in the slot 490 for constantly biasing the developing roller 402 against the drum 1. In FIG. 31, when the moving mechanism assigned to the coating device releases the developing roller 402 from the drum 1, the developing roller 402 is moved toward the drum i along the slot 490 under the action of the spring 491. As a result, as shown in FIG. 32, the developing roller 402 is automatically released from the intermediate roller 405.

In the developing device in which the intermediate roller 405 is rotated in the opposite direction to the developing roller 402, a heavier drive torque is necessary than in the developing device in which the roller 405 is rotated in the same direction as the roller 402. In addition, the drive torque is generally heavy at the initial stage of drive and decreases during continuous, drive. Considering such a drive torque, the illustrative embodiment causes the developing roller 402 and intermediate roller 405 to rotate while being spaced from each other at the initial stage of drive and then brings them into contact with each other. This successfully reduces the initial drive torque. It is preferably to cause the developing roller 402 and intermediate roller 405 to stop rotating after releasing them from each other.

At stated above, the illustrative embodiment protects the developing roller 402 from deformation and protects the thin developer layer from irregularity and stripes ascribable to impurities introduced in the developing device 4, thereby insuring stable, high image quality. Further, the illustrative embodiment insures the durability of the developing roller 402 and intermediate roller 405 by so preventing the entry of impurities, maintaining the quality of the developing device 4 itself stable.

A continuous image forming test conducted with the illustrative embodiment proved that even after the output 20,000 prints, the degradation of image quality ascribable to the scratches of the developing roller 402 derived from mechanical stress was not observed. Moreover, when the surface of the drum 1 was formed of a-Si, the drum 1 achieved higher mechanical strength and therefore longer life than when the surface was formed of OPC.

Third Embodiment

Figure 33:
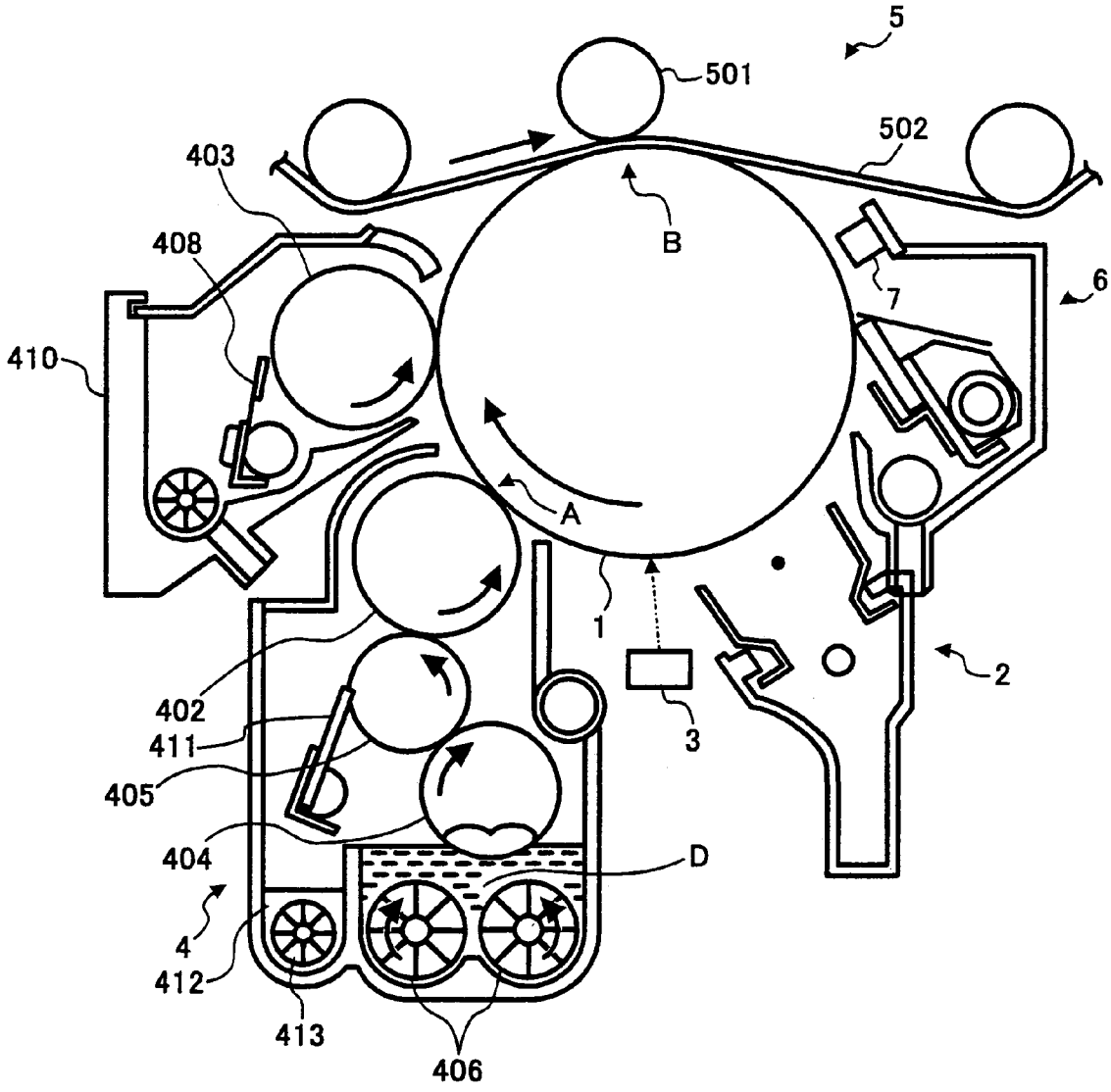
FIG. 33 shows major part of a third embodiment of the image forming apparatus in accordance with the present invention.

Referring to FIG. 33, another alternative embodiment of the present invention also implemented as an electrophotographic copier will be described hereinafter. As shown, as for basic construction, the illustrative embodiment is generally identical with the embodiment shown in FIG. 4 or 20. The following description will concentrate on features unique to the illustrative embodiment in order to avoid redundancy.

This embodiment is also capable of obviating the degradation of image quality ascribable to the scratches of the intermediate roller 405 or those of the developing roller 402 derived from mechanical stress even after 20,000 prints are output, as also determined by a continuous image forming test. However, when the continuous image forming test was extended, the surface of the intermediate roller 405 was scratched before the developing roller 402 and lowered image quality. Stated another way, the life of the intermediate roller 405 was shorter than the life of the developing roller 402, making the coating of the developing liquid on the roller 402 unstable before the life of the roller 402 ended. The illustrative embodiment solves this problem with any one of specific examples to be described hereinafter.

EXAMPLE 1

To further enhance the durability of the structural elements while preserving high image quality, Example 1 executed continuous image forming tests by paying attention to the surface roughness of the intermediate roller 405. FIG. 34 shows the results of the continuous image forming tests. As shown, when the intermediate roller 405 has its surface roughness increased to a certain degree, the scratches of the roller 405 sharply decrease, i.e., the life of the roller 405 is extended. In light of this, in Example 1, the intermediate roller 405 is provided with surface roughness Rz of 3 $\mu$m or above in terms of ten-point mean roughness.

Figure 35:
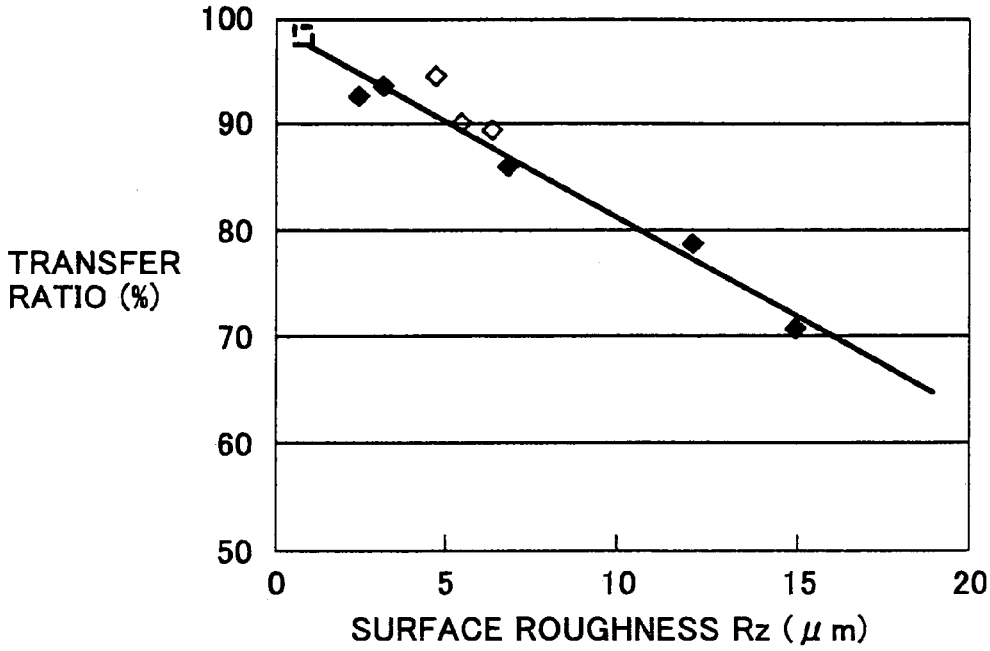
FIG. 35 is a graph showing a relation between the surface roughness of the intermediate roller and the transfer ratio of a developing liquid to a developing roller also included in the developing device.

FIG. 35 shows a relation between the surface roughness of the intermediate roller 405 and the transfer ratio of the developing liquid from the roller 405 to the developing roller 402, as determined by experiments. As shown, the transfer ratio decreases with an increase in the surface roughness of the intermediate roller 405. This means that the amount of the developing liquid passed through the nip between the intermediate roller 405 and the developing roller 402 increases with an increase in surface roughness. Example 1 presumably protects the intermediate roller 405 and developing roller 402 sliding on each other from scratches because of such an increase in the amount of the developer passed through the above nip.

EXAMPLE 2

The toner content of the developing liquid left on the developing roller 402 after development differs from the image portion to the non-image portion of the drum. Therefore, if the developing liquid is again coated on the developing roller 402 for the next development over the residual developing liquid, then the ghost of the previous image pattern remains. It is therefore necessary to remove the developing liquid used for the previous development from the developing roller 402 before again coating the roller 402.

It is a common practice with the developing device to remove the residual developing liquid from the developing roller 402 by use of a blade held in contact with the surface of the roller 402. The blade, however, is apt to scratch the developing roller 402.

In light of the above, in Example 2, the cleaning blade 411 is held in contact with the intermediate roller 405. More specifically, the toner left on the developing roller 402 is removed by the intermediate roller 405, and then the cleaning blade 411 removes the developing liquid collected by the intermediate roller 405. The developing liquid removed by the cleaning blade 411 is not directly used for development, but is conveyed to the density adjusting section stated previously. After the density adjusting section has adjusted the toner content of the collected developing liquid, the liquid is returned to the coating device. With this configuration, it is possible to reduce the mechanical load on the surface of the developing roller 402 for thereby extending the life of the roller 402 while preserving high image quality.

In the case where the intermediate roller 405 removes the residual developing liquid from the developing roller 402, as stated above, the surface roughness of the roller 405 has influence on the cleaning of the roller 402. The transfer ratio shown in FIG. 35 may be translated into a cleaning ratio. Experiments showed that when the transfer ratio was less than 70%, the ghost of the previous image pattern appeared. In Example 2, the surface roughness Rz of the intermediate roller 405 is selected to be 15 $\mu$m or below in terms of ten-point mean roughness to thereby implement the transfer ratio of 70% or above. With this configuration, the intermediate roller 405 can remove the residual developing liquid from the developing roller 402 and reduce the mechanical load on the roller 402 while obviating a ghost.

EXAMPLE 3

Figure 36:
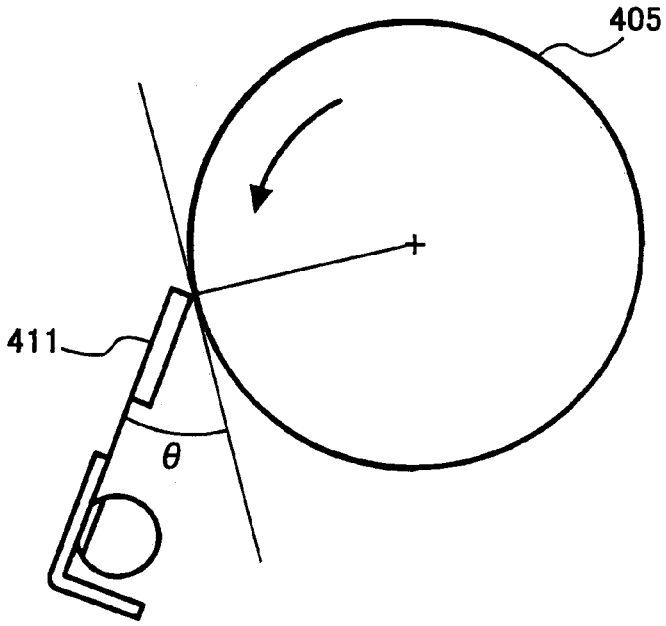
FIG. 36 is a view for describing two different conditions in which a cleaning blade may contact the intermediate roller.

Generally, as shown in FIG. 36, the cleaning blade 411 is held in contact with the intermediate roller 405 in either one of two different positions with respect to an angle θ. More specifically the cleaning blade 411 contacts the intermediate roller 405 in the counter direction when the angle θ is smaller than 90° or contacts it in the trailing direction when the angle θ is greater than or equal to 90°. As for the trailing position, the residual developing liquid removed by the cleaning blade 411 turns round in the lengthwise direction of the blade 411 in the wedge-like space between the blade 411 and the roller 405 and therefore deposits more on the end of the roller 411. Part of the developing liquid deposited on the end of the roller 405 cannot be collected, but is returned to the coating device without having its toner content adjusted. The trailing position therefore makes it difficult to control the toner content of the developing liquid.

By contrast, if the cleaning blade 411 is held in the counter direction and made thin, it is possible to reduce the turn-round of the developing liquid in the lengthwise direction of the blade 411. In Example 3, therefore, the cleaning blade 411 is held in contact with the intermediate roller 405 in the counter direction and implemented as a rubber blade as thin as 1 mm. The rubber blade is adhered to a 0.2 μmm thick sheet of metal. If the cleaning blade 411 should be pressed against the intermediate roller 405 with sufficient pressure, then the blade 411 must be as thick as about 3 mm.

As stated above, the cleaning blade 411, contacting the intermediate roller 405 in the counter direction, reduces the residual developing roller that it could not collect in the trailing direction and thereby promote adequate control over the toner content of the developing liquid.

EXAMPLE 4

Impurities introduced in the developing liquid are apt to produce stripes in the developer layer formed on the developing roller 402, thereby rendering development defective. Moreover, if such impurities are higher in hardness than the surface of the developing roller 402, then the impurities are likely to scratch the surface of the roller 402 and reduce the life of the roller 402. While the second embodiment stated earlier arranges the coating device and developing roller 402 in the substantially hermetically closed container in order to solve the above problem, it is difficult to fully hermetically confine the developing device 4 or the coating device, i.e., to fully obviate the introduction of impurities in the developing liquid.

Experiments were conducted to see how image quality and the life of a roller were effected by scratches formed on the surface of the roller by impurities. The experiments showed that dust and other impurities accumulated at the edge of a cleaning blade, which contacted the roller surface, and caused scratches to extend from such a position over the circumference of the roller. More specifically, when the coating device continuously coated the developing liquid on the developing roller 402, impurities E gathered between the surface of the intermediate roller 405 and the cleaning blade 411 and caused scratches to extend from the impurities over the circumference of the roller 405. Such impurities E should preferably be removed because it is difficult to fully obviate the entry of impurities in the developing device 4, as stated earlier.

To remove the impurities E, the cleaning blade 411 maybe released from the intermediate roller 405. However, if the intermediate roller 405 is rotated after the release of the cleaning blade 411, then the roller 405 conveys the impurities to the nip between the roller 405 and the coating roller 404, causing the impurities E to again appear at the coating position.

Figure 37A:
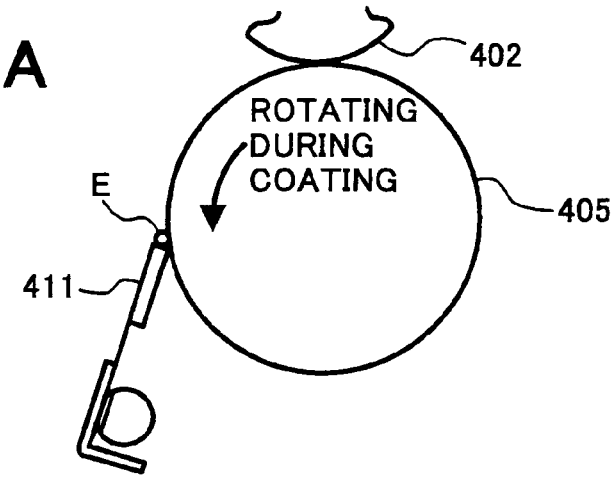
FIGS. 37A through 37C demonstrate the behavior of impurities caught between the intermediate roller and the cleaning blade.
Figure 37B:
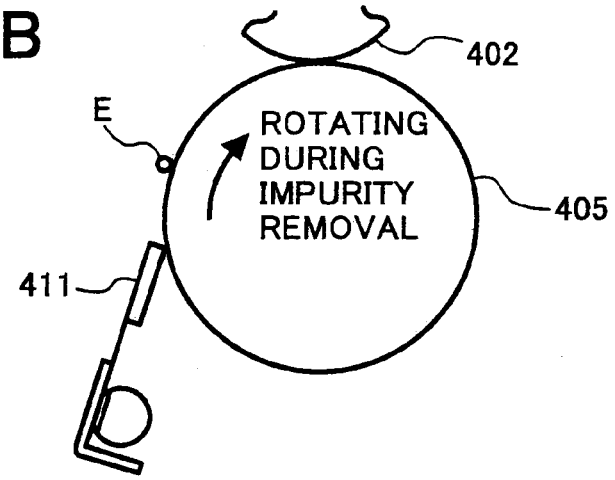
Figure 37C:
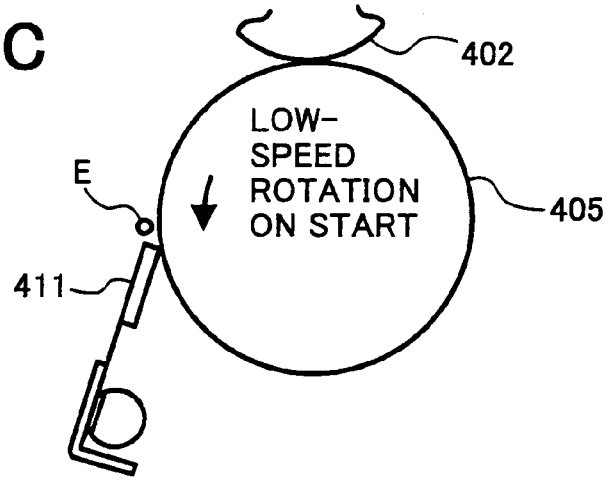

In light of the above, Example 4 includes rotation switching means for switching the direction of rotation of the intermediate roller 405. The rotation switching means may be implemented as a driveline using a reversible stepping motor or a reversible DC motor. When the rotation switching means causes the intermediate roller 405 to rotate in the direction opposite to the usual direction assigned to coating, the impurities E are pulled out of the nip (cleaning position) between the cleaning blade 411 and the roller 405, as shown in FIG. 37B. At this time, the cleaning blade 411 contacts the intermediate roller, which is rotating in the reverse direction, in the trailing direction, allowing the impurities E to easily move away from the cleaning position. This successfully protects the surface of the intermediate roller 405 from scratches ascribable to the impurities E. Subsequently, as shown in FIG. 37C, the rotation switching means again causes the intermediate roller 405 to rotate in the usual direction, so that the cleaning blade 411 can remove the impurities E from the intermediate roller 405.

EXAMPLE 5

In Example 5, the distance over which the surface of the developing roller 405 moves in the reverse direction, as stated above, is selected to be smaller than the distance between the nip between the roller 405 and the cleaning blade 411 and the nip between the roller 405 and the developing roller 402. Stated another way, the angular movement of the intermediate roller 405 in the reverse direction is selected such that the cleaning position at the beginning of the reverse rotation does not reach the nip between the rollers 405 and 402, see FIG. 37B. In this condition, the impurities pulled out of the cleaning position are prevented from reaching the nip between the rollers 405 and 402 and depositing on the roller 402 when the roller 405 is rotated in the reverse direction.

EXAMPLE 6

Even when the cleaning roller 411 removes the impurities when the intermediate roller 405 is rotated in the usual direction as in Example 5, the impurities E are apt to again stay at the cleaning position. More specifically, it is, in practice, impossible to fully remove the developing liquid from the intermediate roller 405 with the cleaning blade 411. As a result, some developing liquid presumably moves past the cleaning position and causes the impurities E to stay at the cleaning position.

Generally, when a liquid passes through a nip between two objects pressed against each other, the passage becomes more difficult as the moving speed of the liquid increases. Taking this fact into account, Example 6 makes the rotation speed of the intermediate roller 405 lower when the impurities E pulled out of the cleaning position are again brought to the cleaning position than the usual rotation speed assigned to coating, see FIG. 37C. The lower speed of the intermediate roller 405 reduces the amount of the developing liquid to pass through the cleaning position for thereby allowing a minimum of impurities to stay at the cleaning position.

Figure 38:
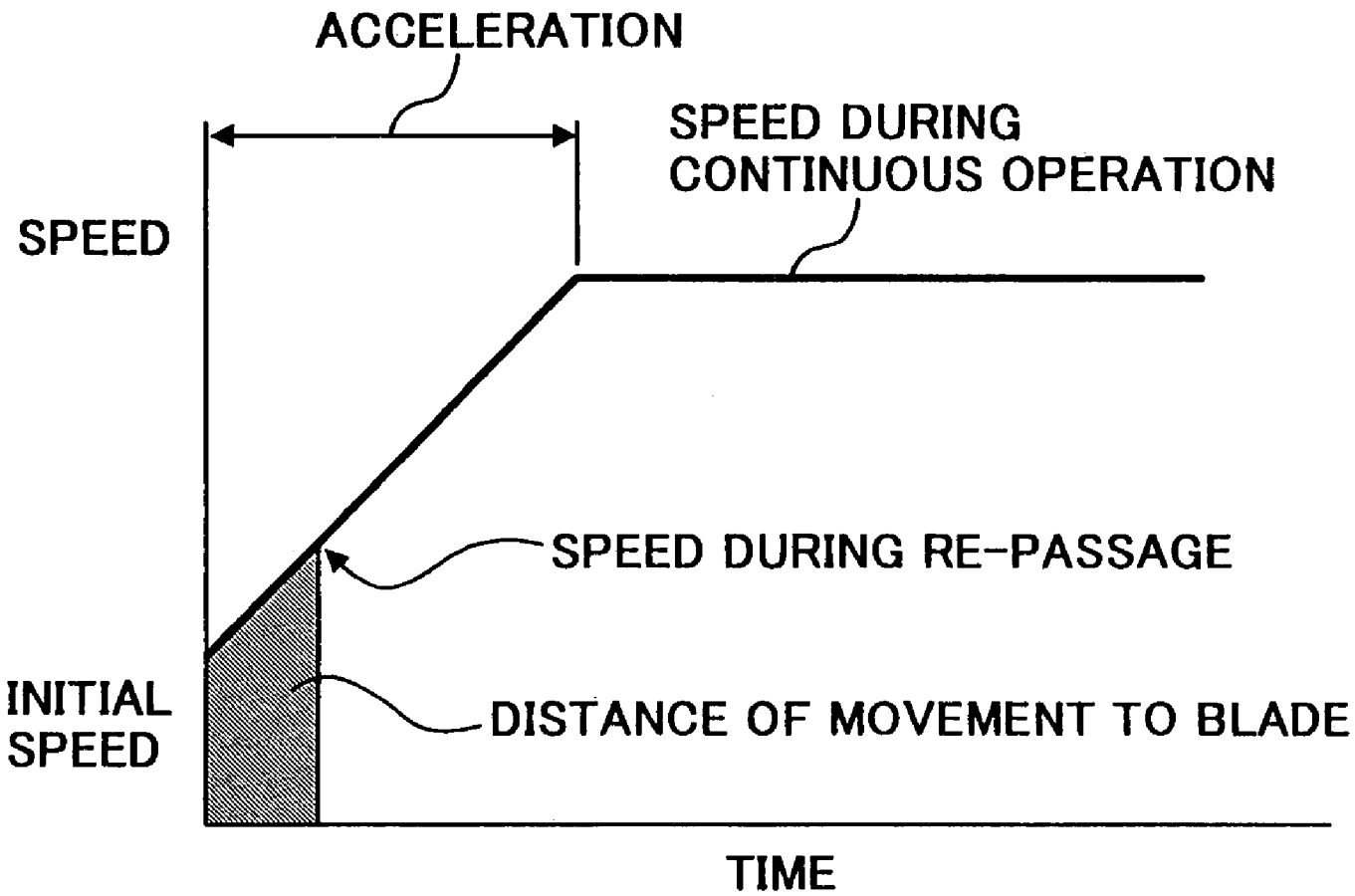
FIG. 38 is a graph showing set values available with a stepping motor or drive source for driving the intermediate roller.

To control the rotation speed of the intermediate roller 405, use may be made of a speed control motor or a stepping motor. In Example 6, a stepping motor is used in order to control the amount of rotation of the intermediate roller 405 on the basis of the number of steps of the motor. More specifically, a stepping motor is selectively rotatable at an initial speed or a steady operation speed and can be accelerated for a preselected period of time. As shown in FIG. 38, in Example 6, the initial speed and the duration of acceleration are controlled such that the rotation speed of the intermediate roller 405 is lowered when the impurities E are again brought to the cleaning position. This makes it needless to set two different rotation speeds of the intermediate roller 405 that would make control sophisticated.

EXAMPLE 7

The impurities removed from the intermediate roller 405 at the cleaning position are conveyed to the density or toner content adjusting section together with the developing liquid. A filter, not shown, is disposed on the path connecting the cleaning position and the toner content adjusting section and filters out the impurities E. The filter, however, needs periodic replacement because it is stopped up as the time elapses. It is therefore not efficient to convey the impurities E pulled out of the cleaning position to the filter via the above path.

Figure 39A:
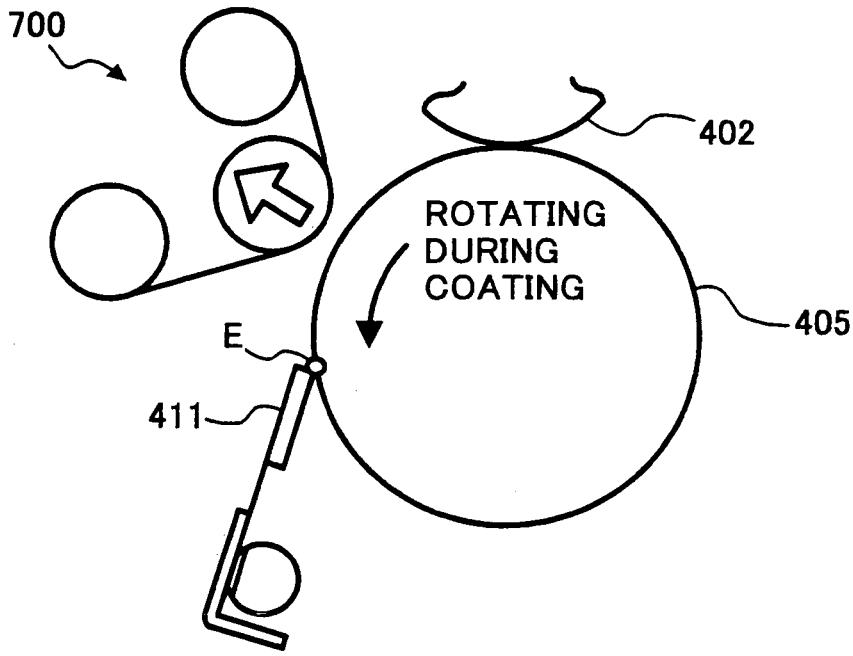
FIGS. 39A and 39B demonstrate the behavior of a removing member for removing the impurities.
Figure 39B:
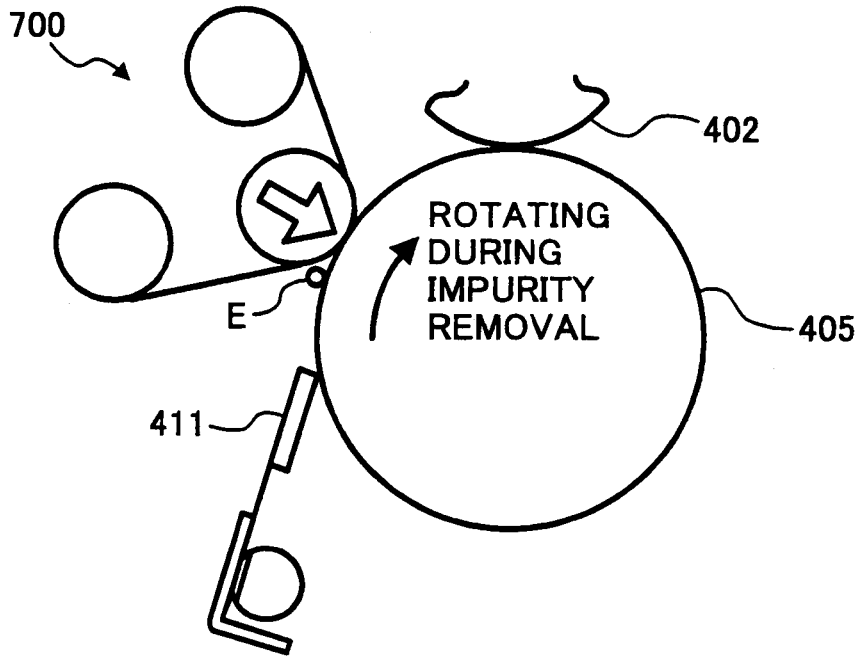

In light of the above, as shown in FIGS. 39A and 39B, Example 7 includes a removing member 700 for removing the impurities E deposited on the intermediate roller 405. As shown, the removing member 700 is selectively movable into or out of contact with the intermediate roller 405 at a position between the developing roller 402 and cleaning blade 411 and removes the impurities E pulled out of the cleaning position. While the removing member 700 may be implemented as, e.g., a roller, it should preferably be implemented as a webbing when consideration is given to the removal of the impurities E from the intermediate roller 405, as illustrated. The webbing is implemented by unwoven cloth of cotton that is highly hygroscopic and releases a minimum of substances.

As shown in FIG. 39A, during usual coating operation, the removing member 700 is spaced from the intermediate roller 405. As shown in FIG. 39B, at the time when the intermediate roller 405 is rotated in the reverse direction to allow the impurities to be removed, the removing member 700 is brought into contact with the roller 405 for thereby removing the impurities E. The webbing, constituting the removing member 700, can be taken up to replace its portion smeared with the impurities E with a fresh portion, preventing the removed impurities E from being returned to the intermediate roller 405.

As stated above Examples 4 through 7 can periodically remove the impurities that would otherwise scratch the surface of the intermediate roller 405, would lower image quality, and would reduce the life of structural parts. The removal of the impurities E is automatically effected after a preselected amount of developing liquid has been coated on the intermediate roller 405, e.g., every time 50,000 prints are output. Alternatively the removal of the impurities may be automatically effected every time a power switch, not shown, is turned on or may even be effected by the user any time in accordance with an operation manual.

The smooth layer 405*c* of the intermediate roller 405 is formed by coating a coating agent containing fluorocarbon resin on the elastic layer 405*b* to thickness of 10 μm to 50 μm; the elastic layer 405*b* is formed of urethane resin and has hardness of 40° in terms of JIS-A scale. While the smooth layer 405*c* may be implemented by, e.g., a PFA tube, as stated earlier, the PFA tube determines the surface roughness of the intermediate roller 405 alone. It is difficult to control the surface roughness of a tube and therefore the surface roughness of the intermediate roller 405. To solve this problem, in the illustrative embodiment, the smooth layer 405*c* is formed on the elastic layer 405*b* by coating. A coating method, which may be dipping, spraying or the like, is dependent on the material of the intermediate roller 405 and coating material.

Figure 40:
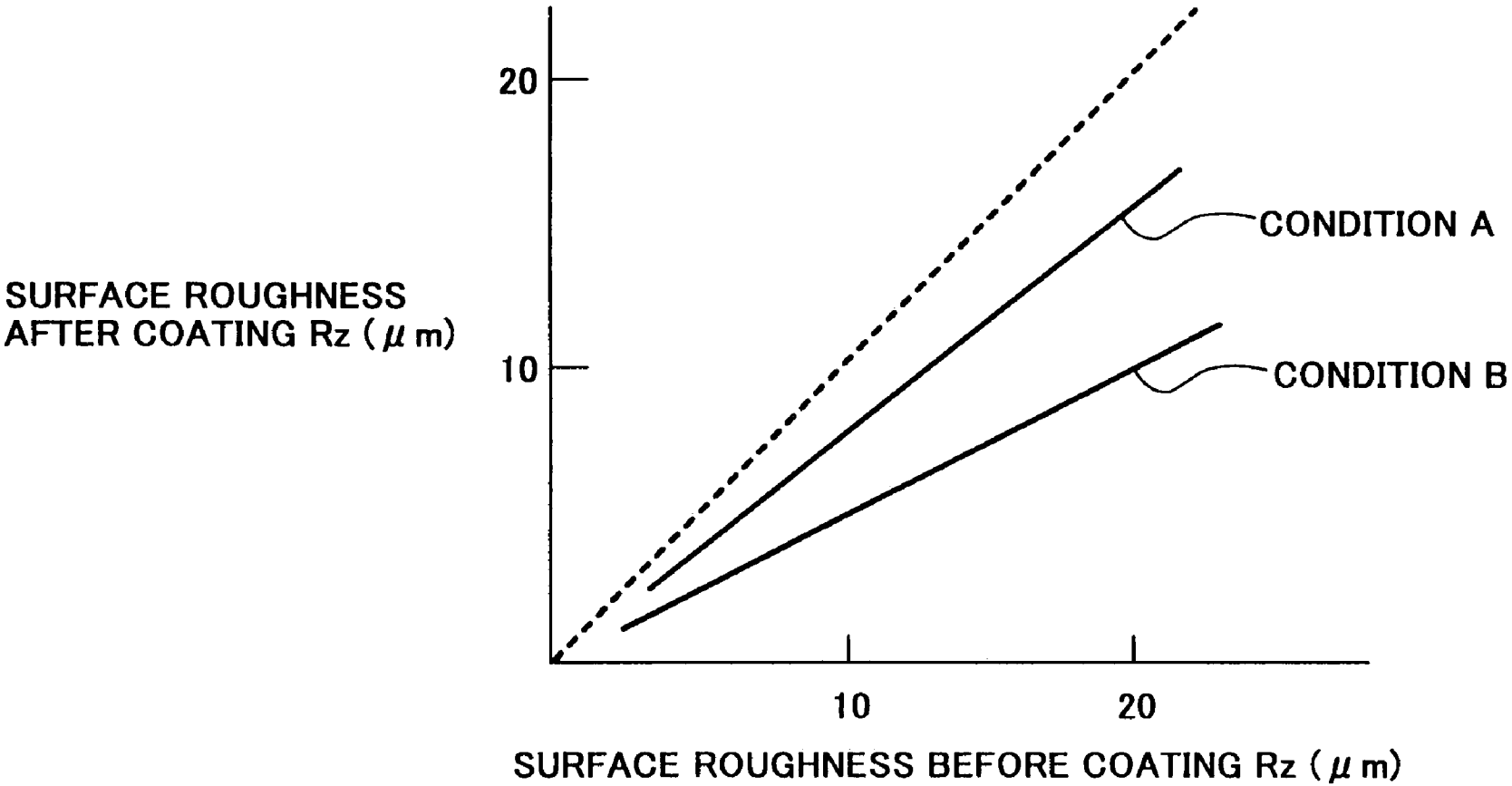
FIG. 40 is a graph showing a relation between the surface roughness of the intermediate roller after coating and the surface roughness of the same before coating.

As for the method stated above, the surface roughness of the intermediate roller 405 may be controlled either by (1) processing the surface layer of the elastic layer and (2) selecting an adequate coating method and an adequate material for the coating layer. The illustrative embodiment uses the above scheme (1). Generally, a rubber roller is produced by forming a rubber layer or elastic layer on a metallic core and then grinding the surface of the rubber layer. In the illustrative embodiment, the surface roughness of the intermediate roller 405 is controlled by grinding. For a given coating condition, surface roughness after coating varies substantially in proportion to surface roughness before coating and is 0.5 time to 0.8 time greater than the latter in terms of Rz value although dependent on conditions, as shown in FIG. 40. Therefore, if the elastic layer 405*b* is ground with the above variation being taken into account, then the surface roughness after coating can be controlled.

The other scheme (2) is difficult to practice because coating itself originally tends to reduce surface roughness. Although grains for controlling surface roughness may be introduced in a coating material, such grains bring about another problem that surface roughness becomes irregular due to, e.g., short dispersion. In this sense, the scheme (1) is advantageous over the scheme (2) in the aspect of stable control over surface roughness and preservation of the ability.

In the developing device 4 in which the developing liquid is coated on the developing roller 402, the roller, like the intermediate roller 405 should preferably be provided with surface roughness Rz of 3 μm or above. Such surface roughness of the developing roller 402 is considered to obviate scratches ascribable to mechanical loads, e.g., sliding contact of the roller 402 with the intermediate roller 405. However, a problem with the developing roller 402 is that if its surface roughness is excessively great, then irregularity in surface roughness appears in, e.g., a halftone image. Experiments were conducted by varying the surface roughness of the developing roller 402 and showed that surface roughness Rz of 5 μm or below obviated the above problem. The illustrative embodiment insures high-quality images with a roller covered with a PFA tube and having surface roughness Rz of 2 μm to 3 μm.

A continuous image forming test conducted with the developing device 4 of the illustrative embodiment showed that even when 400,000 prints were output, image quality was free from degradation ascribable to the scratches of the intermediate roller 405 brought about by mechanical stress. Further, the drum 1 achieves greater mechanical strength and therefore a longer life when implemented by a-Si than when implemented by OPC.

Various modifications will become possible for those skilled in the art after receiving the teachings of the present disclosure without departing from the scope thereof.

What is claimed is:

1. A method of coating a developing liquid, which is deposited on a surface of a rotatable coating member in a preselected amount, on a surface of a subject member to be coated, said method comprising:

preparing an intermediate member having a surface contacting the surface of said coating member and movable at a same speed and in a same direction as said surface of said coating member, and contacting the surface of said subject member and movable in an opposite direction to said surface of said subject member;

coating the developing liquid deposited on the surface of said coating member on the surface of said intermediate member;

coating the developing liquid deposited on the surface of said intermediate member on the surface of said subject member; and rotating the intermediate member in a direction opposite to the direction of the surface of the coating member.

2. A device for coating a developing liquid, comprising:

a coating member rotatable with the developing liquid deposited on a surface thereof in a preselected amount;

an intermediate member having a surface contacting a surface of said coating member and movable at a same speed and in a same direction as said surface of said coating member, and contacting a surface of a subject member to be coated and movable in an opposite direction to said surface of said subject member; and a drive mechanism configured to rotate the intermediate member in a direction opposite to the direction of the surface of the coating member.

3. In a developing device for developing a latent image formed on a surface of an image carrier with a developing liquid on a surface of a developer carrier by a coating device, said coating device comprising:

a coating member rotatable with the developing liquid deposited on a surface thereof in a preselected amount;

an intermediate member having a surface contacting the surface of said coating member and movable at a same speed and in a same direction as said surface of said coating member, and contacting a surface of said developer carrier and movable in an opposite direction to said surface of said developer carrier; and a drive mechanism configured to rotate the intermediate member in a direction opposite to the direction of the surface of the coating member.

4. An image forming apparatus comprising:

an image carrier;

image forming means for forming a latent image on a surface of said image carrier; and a developing device for developing the latent image with a developing liquid;

said developing device comprising:

a coating member rotatable with the developing liquid deposited on a surface thereof in a preselected amount;

an intermediate member having a surface contacting the surface of said coating member and movable at a same speed and in a same direction as said surface of said coating member, and contacting a surface of a developer carrier to be coated and movable in an opposite direction to said surface of said developer carrier; and a drive mechanism configured to rotate the intermediate member in a direction opposite to the direction of the surface of the coating member.

5. A device for coating a developing liquid, comprising:

a coating member rotatable with the developing liquid deposited thereon in a preselected amount;

an intermediate member interposed between said coating member and a subject member to be coated with the developing liquid, said intermediate member having a surface contacting a surface of said coating member and movable at a same speed and in a same direction as said surface of said coating member, and contacting a surface of said subject member and movable in an opposite direction to said surface of said subject member; and a drive mechanism configured to rotate the intermediate member in a direction opposite to the direction of the surface of the coating member.

6. A developing device for developing a latent image formed on an image carrier with a developing liquid deposited on a surface of a developer carrier in a thin layer, said developing device comprising:

a coating device comprising a coating member rotatable with the developing liquid deposited thereon in a preselected amount, an intermediate member interposed between said coating member and said developer carrier to be coated with the developing liquid, said intermediate member having a surface contacting a surface of said coating member and movable at a same speed and in a same direction as said surface of said coating member, and contacting the surface of said developer carrier and movable in an opposite direction to said surface of said developer carrier and a drive mechanism configured to rotate the intermediate member in a direction opposite to the direction of the surface of the coating member; and a moving mechanism for selectively moving said developer carrier into or out of contact with said image carrier.

7. A developing device for developing a latent image formed on an image carrier with a developing liquid deposited on a surface of a developer carrier in a thin layer, said developing device comprising:

a coating device comprising a coating member rotatable with the developing liquid deposited thereon in, a preselected amount, an intermediate member interposed between said coating member and said developer carrier to be coated with the developing liquid, said intermediate member having a surface contacting a surface of said coating member and movable at a same speed and in a same direction as said surface of said coating member, and contacting the surface of said developer carrier and movable in an opposite direction to said surface of said developer carrier, and a drive mechanism configured to rotate the intermediate member in a direction opposite to the surface of the coating member; and a container hermetically closed except for an inlet port for feeding the developing liquid, an outlet port for discharging said developing liquid and an opening via which said developing carrier contacts said image carrier, said container accommodating said coating device and said developer carrier.

8. A device for coating a developing liquid, comprising:

a coating member rotable with the developing liquid deposited thereon in a preselected amount;

an intermediate member interposed between said coating member and a subject member to be coated with the developing liquid, said intermediate member having a surface contacting a surface of said coating member and movable at a same speed and in a same direction as said surface of said coating member, and contacting a surface of said subject member and movable in an opposite direction to said surface of said subject member;

a moving mechanism for selectively moving said intermediate member into or out of contact with said coating member; and a drive mechanism configured to rotate the intermediate member in a direction opposite to the surface of the coating member.

9. An image forming apparatus comprising:

an image carrier for forming a latent image thereon;

a developing device for developing the latent image with a developing liquid deposited on a surface of a developer carrier, which is movable in contact with a surface of said image carrier; and a coating device for coating the developing liquid on the surface of said developer carrier, said coating device comprising a coating member rotatable with the developing liquid deposited thereon in a preselected amount, an intermediate member interposed between said coating member and said developer carrier to be coated with said developing liquid, said intermediate member having a surface contacting a surface of said coating member and movable at a same speed and in a same direction as said surface of said coating member, and contacting the surface of said developer carrier and movable in an opposite direction to said surface of said developer carrier, a moving mechanism for selectively moving said intermediate member into or out of contact with said coating member, and a drive mechanism configured to rotate the intermediate member in a direction opposite to the surface of the coating member.

10. A device for coating a developing liquid on a surface of a developer carrier, said coating device comprising:

a coating member rotatable with the developing liquid deposited thereon in a preselected amount;

an intermediate member having a surface contacting a surface of said coating member and movable at a same speed and in a same direction as said surface of said coating member, and contacting the surface of said developer carrier and movable in an opposite direction to said surface of said developer carrier, said intermediate member having surface roughness of 3 $\mu$m or above in terms often-point mean roughness Rz; and a drive mechanism configured to rotate the intermediate member in a direction opposite to the surface of coating member.

11. A device for coating a developing liquid on a surface of a developer carrier, said coating device comprising:

a coating member rotatable with the developing liquid deposited thereon in a preselected amount;

an intermediate member having a surface contacting a surface of said coating member and movable at a same speed and in a same direction as said surface of said coating member, and contacting the surface of said developer carrier and movable in an opposite direction to said surface of said developer carrier, and developer removing means contacting a position of the surface of said intermediate member between said developer carrier and said coating member, which are respectively positioned downstream and upstream in a direction of movement of the surface of said intermediate member when the developing liquid is to be coated on the surface of said developer carrier, for removing said developing liquid deposited on the surface fo said intermediate member; and a drive mechanism configured to rotate the intermediate member in a direction opposition to the surface of the coating member, said intermediate member having surface roughness of 15 $\mu$m or below in terms of ten-point mean surface roughness Rz.

12. An image forming apparatus comprising:

an image carrier for forming a latent image thereon;

latent image forming means for forming the latent image on surface of said image carrier; and developing means for developing the latent image;

said developing means comprising:

a coating member rotatable with a developing liquid deposited thereon in a preselected amount;

an intermediate member having a surface contacting a surface of said coating member and movable at a same speed and in a same direction as said surface of said coating member, and contacting a surface of a developer carrier to be coated with the developing liquid and movable in an opposite direction to said surface of said developer carrier, said intermediate member having surface roughness of 3 $\mu$m or above in terms often-point mean roughness Rz; and a drive mechanism configured to rotate the intermediate member in a direction opposite to the surface of the coating member.

13. An image forming apparatus comprising:

an image carrier for forming a latent image thereon;

latent image forming means for forming the latent image on a surface of said image carrier; and developing means for developing the latent image;

said developing means comprising:

a coating member rotatable with a developing liquid deposited thereon in a preselected amount;

an intermediate member having a surface contacting a surface of said coating member and movable at a same speed and in a same direction as said surface of said coating member, and contacting a surface of a developer carrier to be coated with the developing liquid and movable in an opposite direction to said surface of said developer carrier; and developing removing means contacting a position of the surface of said intermediate member between said developer carrier and said coating member, which are respectively positioned downstream and upstream in a direction of movement of the surface of said intermediate member when the developing liquid is to be coated on the surface of said developer carrier, for removing said developing liquid deposited on the surface of said intermediate member; and a drive mechanism configured to rotate the intermediate member in a direction opposite to the surface of the coating member, said intermediate member having surface roughness of 15 $\mu$m or below in terms of ten-point mean surface roughness Rz.

* * * * *